US010634293B1

(12) United States Patent
Green et al.

(10) Patent No.: US 10,634,293 B1
(45) Date of Patent: Apr. 28, 2020

(54) RETROFIT LIGHT FIXTURE

(71) Applicant: ORION ENERGY SYSTEMS, INC., Manitowoc, WI (US)

(72) Inventors: Scott Green, Ponte Vedra Beach, FL (US); Matthew Tlachac, Manitowoc, WI (US); George Wilson, Middleburg, FL (US); Marc Meade, Manitowoc, WI (US); Daniel Fonseca, Manitowoc, WI (US); Ron Ogletree, Manitowoc, WI (US)

(73) Assignee: Orion Energy Systems, Inc., Manitowoc, WI (US)

( * ) Notice: Subject to any disclaimer, the term of this patent is extended or adjusted under 35 U.S.C. 154(b) by 0 days.

(21) Appl. No.: 16/523,975

(22) Filed: Jul. 26, 2019

Related U.S. Application Data

(60) Provisional application No. 62/768,818, filed on Nov. 16, 2018.

(51) Int. Cl.

| | |
|---|---|
| ***F21K 9/27*** | (2016.01) |
| ***F21K 9/275*** | (2016.01) |
| ***F21K 9/272*** | (2016.01) |
| ***F21V 21/03*** | (2006.01) |
| ***F21S 8/02*** | (2006.01) |
| *F21Y 115/10* | (2016.01) |
| *F21Y 103/10* | (2016.01) |

(52) U.S. Cl.
CPC ..... *F21K 9/275* (2016.08); *F21K 9/272* (2016.08); *F21S 8/026* (2013.01); *F21V 21/03* (2013.01); *F21Y 2103/10* (2016.08); *F21Y 2115/10* (2016.08)

(58) Field of Classification Search
CPC . F21K 9/237; F21K 9/238; F21K 9/27; F21K 9/275; F21K 9/272; F21S 8/026; F21S 8/046; F21S 8/06; F21V 21/03; F21V 21/08
See application file for complete search history.

(56) References Cited

U.S. PATENT DOCUMENTS

| | | | | |
|---|---|---|---|---|
| 2014/0043827 | A1* | 2/2014 | Kim | F21S 8/026 362/311.02 |
| 2014/0265930 | A1* | 9/2014 | Harris | H05B 33/0842 315/307 |
| 2015/0267873 | A1* | 9/2015 | Price | F21V 21/03 362/432 |
| 2018/0259164 | A1* | 9/2018 | Clements | F21V 17/002 |

* cited by examiner

*Primary Examiner* — Y. M. Quach Lee
(74) *Attorney, Agent, or Firm* — Foley & Lardner LLP

(57) ABSTRACT

A retrofit assembly has a pan and a light emitting diode (LED) light source. The pan has a base extending along a longitudinal axis. The base is defined by a plurality of segments, including a seat, first and second legs, a first foot, a second foot, and retaining walls. The seat extends in a first plane. The first and second legs angle laterally and vertically away from opposite sides of the seat. The first foot extends away from the first leg within a second plane offset from and parallel to the first plane. The second foot extends away from the second leg within a third plane offset from and parallel to the first plane. The retaining walls extend vertically away from each of the first and second feet toward the first plane. The LED light source supports a plurality of LEDs coupled to the base.

18 Claims, 24 Drawing Sheets

RETROFIT LIGHT FIXTURE

CROSS-REFERENCE TO RELATED APPLICATION

This application claims the benefit of and priority to U.S. Provisional Patent Application No. 62/768,818, filed Nov. 16, 2018, the content of which is hereby incorporated by reference in its entirety.

BACKGROUND

Light fixtures, such as those for interior lighting applications, include light sources secured to enclosures. The light sources may contain various lighting elements (e.g., fluorescent elements, metal halide fixtures, etc.), which may be subject to failure during the useful life of the light fixture. More efficient lighting technologies may additionally or alternatively justify replacing an existing light source. However, the light sources are typically replaced by similar light sources (e.g., a failed fluorescent light fixture may be replaced by another fluorescent light fixture, etc.) because it is often difficult to retrofit an existing lighting fixture for operation with a different lighting technology. As a result, existing lighting fixtures are typically limited in their ability to utilize new, and more efficient, light sources.

SUMMARY

One exemplary embodiment relates to a retrofit assembly. The retrofit assembly has a pan, a light emitting diode (LED) light source, and a lens. The pan has a base extending along a longitudinal axis. The base is defined by a plurality of segments, including a seat, first and second legs, first and second feet, and first and second retaining walls. The seat extends in a first plane. The first leg and the second leg angle laterally and vertically away from opposite sides of the seat. The first foot extends away from the first leg within a second plane that is offset from and parallel to the first plane. The second foot extends away from the second leg within a third plane that is offset from and parallel to the first plane. The first retaining wall and the second retaining wall extend vertically away from the first foot and the second foot toward the first plane. The LED light source supports a plurality of LEDS and is coupled to the base.

Another exemplary embodiment relates to a lighting assembly. The lighting assembly includes a housing and a retrofit assembly. The housing extends along a longitudinal axis and includes a first outer wall and a second outer wall. The housing defines a cavity between the first outer wall and the second outer wall that extends parallel to the longitudinal axis. The retrofit assembly is hingedly coupled to the first outer wall of the housing, and includes a pan and an LED light source. The pan has a base extending along the longitudinal axis, and is defined by a plurality of segments. The segments include a seat, a first leg and a second leg, a first foot and a second foot, and a first retaining wall and a second retaining wall. The seat extends in a first plane. The first leg and second leg angle away from opposite sides of the seat. The first foot extends away from the first leg within a second plane that is offset from the first plane. The second foot extends away from the second leg within a third plane that is offset from the first plane. The first retaining wall and the second retaining wall extend away from the first foot and the second foot toward the first plane. The first retaining wall and the second retaining wall are positioned outside the cavity, and engage an outer surface of the first outer wall and the second outer wall of the housing. The LED light source is coupled to the base.

Another exemplary embodiment relates to a lighting assembly. The lighting assembly includes a housing and a retrofit assembly. The housing extends along a longitudinal axis and defines a cavity between outer walls of the housing that extend parallel to the longitudinal axis. The retrofit assembly is at least partially received within the cavity, and includes a pan, an LED light source, and a lens. The pan has a base extending along the longitudinal axis that is defined by a plurality of segments. The segments include a seat, a first leg and a second leg, a first foot and a second foot, and a first retaining wall and a second retaining wall. The seat extends in a first plane. The first leg and the second leg angle away from opposite sides of the seat. The first foot extends away from the first leg within a second plane that is offset from the first plane. The second foot extends away from the second leg within a third plane that is offset from the first plane. The first retaining wall and the second retaining wall extend away from the first foot and second foot toward the first plane. The first retaining wall and the second retaining wall are positioned outside the cavity, and engage an outer surface of the first outer wall and second outer wall of the housing. The LED light source is coupled to the base. The lens is coupled to the base and at least partially surrounds a portion of the LED light source.

The invention is capable of other embodiments and of being carried out in various ways. Alternative exemplary embodiments relate to other features and combinations of features as may be recited herein.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Referring generally to the figures, a retrofit assembly facilitates retrofitting a light fixture (e.g., troffer, recessed troffer, commercial light, LED fixture, recessed light, high bay fixture, wrap fixture, etc.) and replaces a preexisting lighting element with an LED board. A lens and lighting element of the preexisting lighting fixture may be removed. In some applications, a ballast, ballast plate, and light bulb sockets (e.g., tombstones, etc.) are simultaneously removed and disconnected from the preexisting lighting fixture and/or the input power. Next, the retrofit assembly is installed. The retrofit assembly includes a base, a light source, and a lens, according to an exemplary embodiment. The base includes a series of planar segments that are configured to engage with an existing light fixture so as to couple the retrofit assembly to the existing light fixture. According to an exemplary embodiment, retaining walls on the base are configured to engage with outer surfaces of an existing housing. In some embodiments, the base is formed of a continuous piece of sheet metal bent into a series of planar segments. Additional clips and adaptors can be coupled to the existing housing or base to facilitate installation of the retrofit assemblies into existing housings. For example, clips can be used to form a hinged coupling on one or more sides of the retrofit assembly and existing housing.

Figure 1:
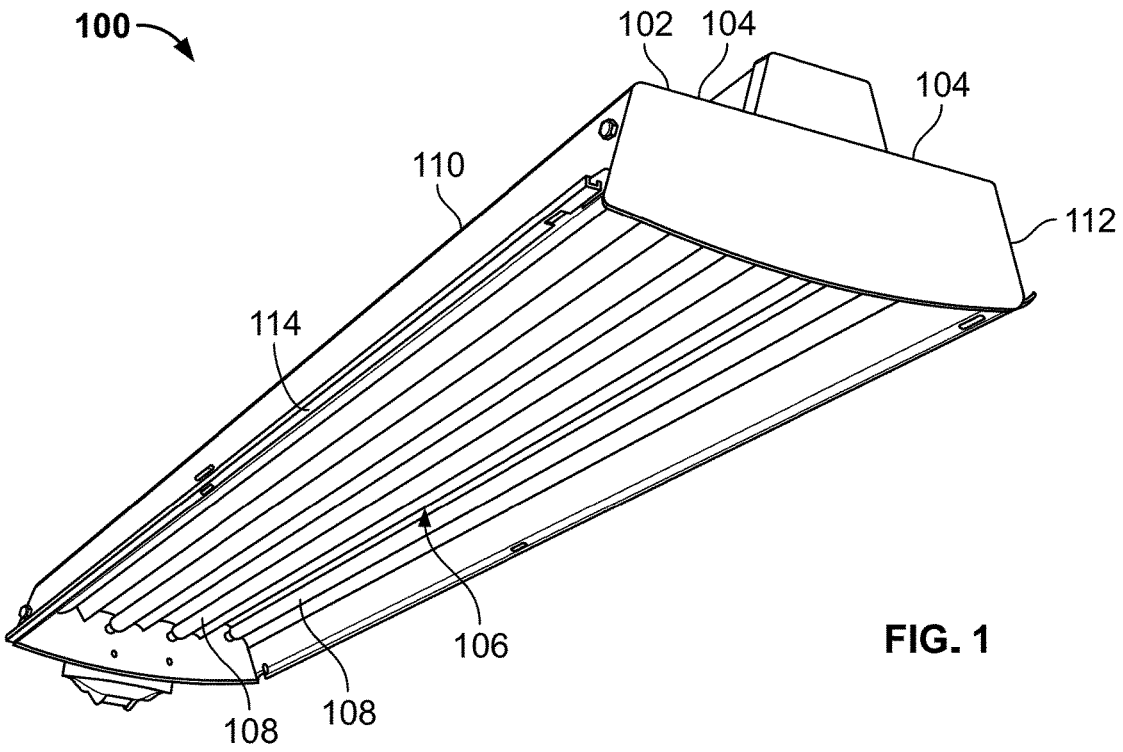
FIG. 1 is a top perspective view of a fluorescent lighting assembly installed in an existing housing.
Figure 2:
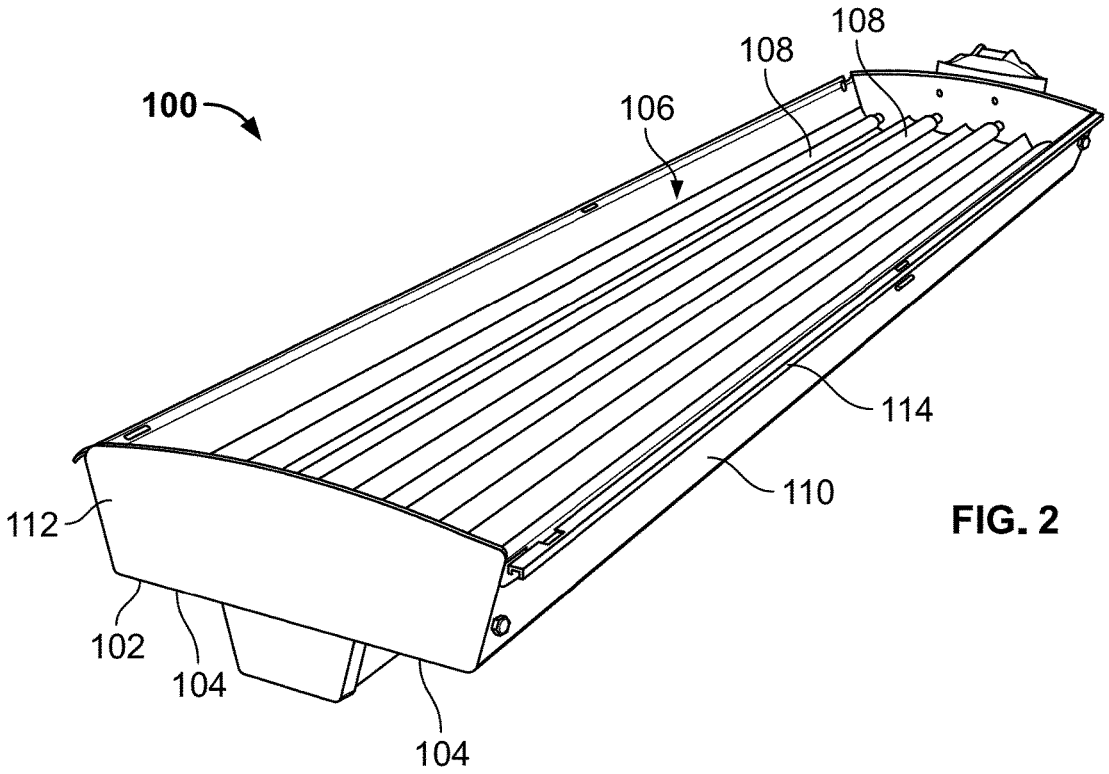
FIG. 2 is a bottom perspective view of the fluorescent lighting assembly and existing housing of FIG. 1.

Referring first to FIGS. 1-2, a lighting assembly 100 is shown. The lighting assembly 100 includes a housing 102 that is defined, generally, by a frame 104. The frame 104 surrounds and encloses a cavity 106 having a variable depth. As depicted in FIGS. 1-2, a middle portion of the frame 104 includes a sunken portion that can accommodate electrical equipment (e.g., cables, controllers, electrical power supplies) to operate fluorescent or incandescent light sources 108 received within the cavity 106. The perimeter of the frame 104 is defined by outer walls 110 and caps 112 that are formed on or otherwise coupled to each end of the frame 104. The outer walls 110 can include at least a portion extending generally vertical (e.g., within about 10 degrees from vertical), and typically include a series of bends. The ends of the frame 104 define the outermost surfaces 114 of the outer wall 110.

Incandescent and fluorescent light sources 108 are less efficient and reliable than LED light sources, so it is advantageous to replace conventional light sources 108 with LEDs. The existing lighting assembly 100 can be retrofit to effectively replace a previous lighting element 108 (e.g., outdated lighting element, inefficient lighting element, damaged lighting element, etc.) with a new lighting element (e.g., high efficiency lighting element, light emitting diodes (LEDs), etc.). During the retrofitting process, the previous lighting element is removed from the existing lighting housing 102. Removal may include removing a mounting component holding or supporting the previous lighting element to housing 102.

Figure 3A:
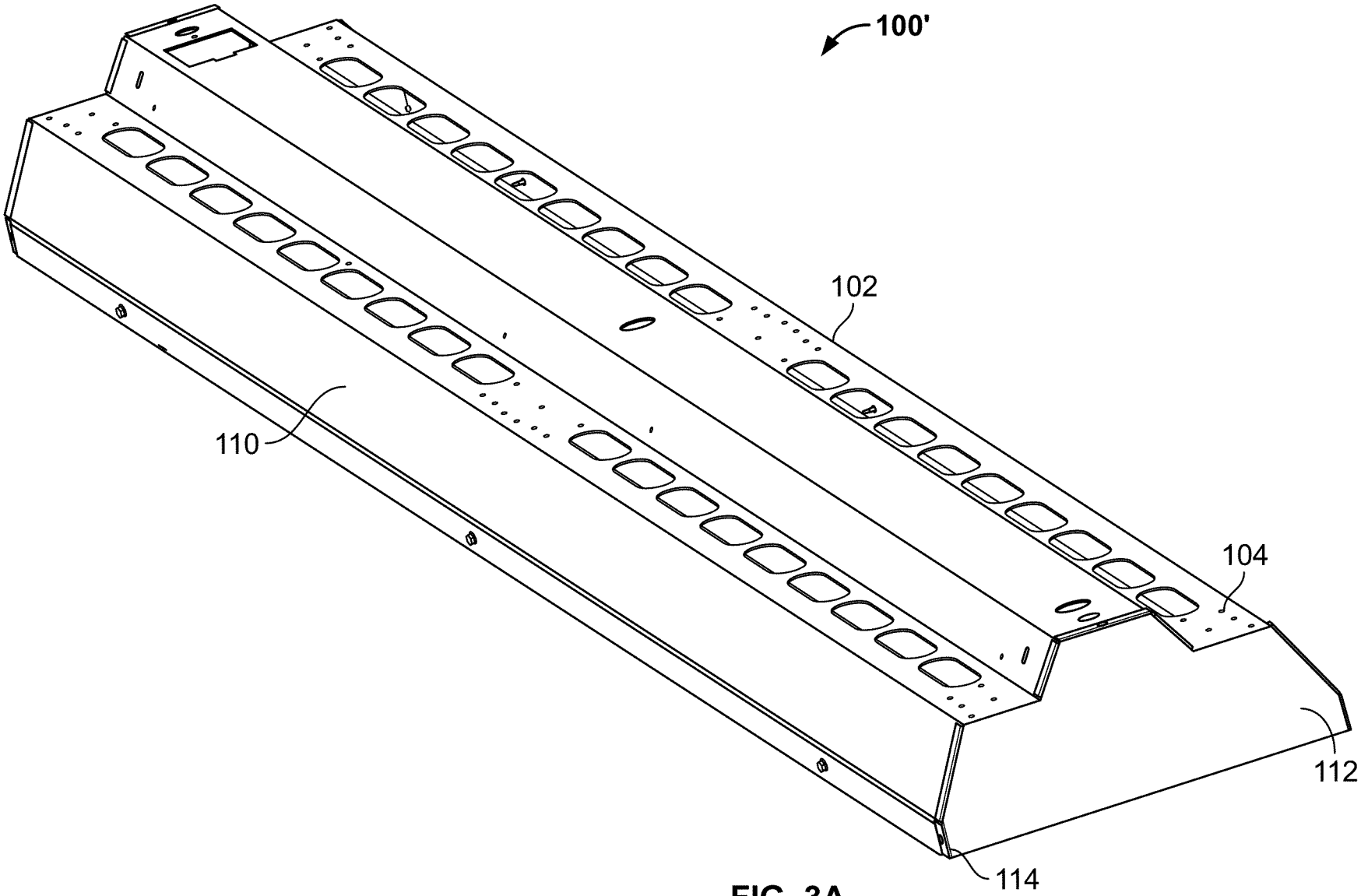
FIG. 3A is a top perspective view of the existing housing of FIG. 1 incorporating a retrofit assembly, according to an exemplary embodiment.
Figure 3C:
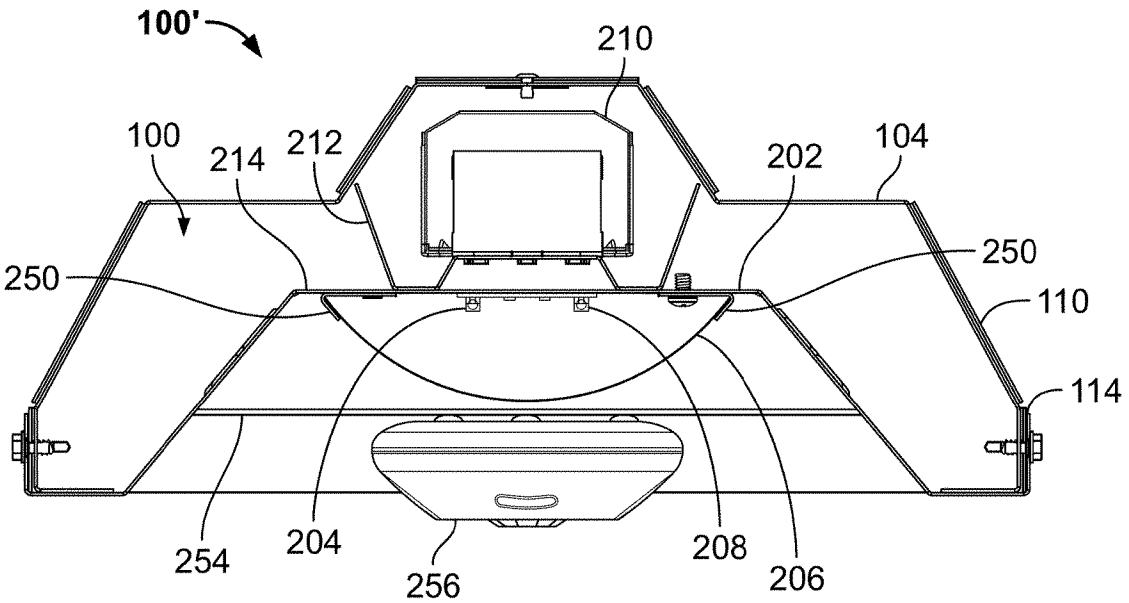
FIG. 3C is a front view of the retrofit assembly of FIG. 3A, with a cover removed for clarity.
Figure 3B:
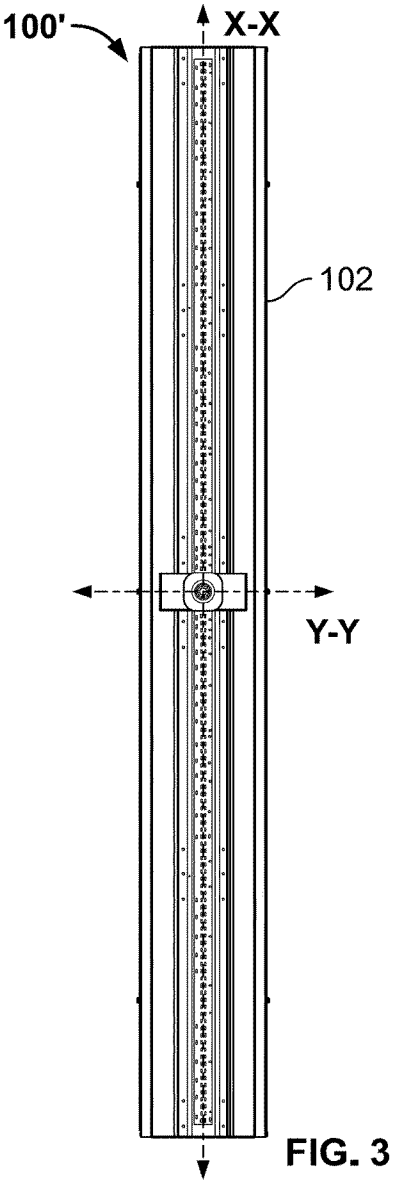
FIG. 3B is a bottom view of the retrofit assembly of FIG. 3A.

As shown in FIGS. 3A-3C, a retrofit assembly 200 can be coupled to the housing 102 to create a more efficient and reliable assembly 100'. The retrofit assembly 200, shown in additional detail in FIGS. 4A-4C, includes a pan having a base, shown as base 202, a light source 204, and a lens 206. The base 202 covers the housing 102 and is secured around and to the frame 104. The light source 204 is coupled to the base 202 at a central position along the base 202 (e.g., along a longitudinal axis X-X of the base 202, etc.). The light source 204 includes a light 208 (e.g., an LED, etc.) and one or more drivers 210. The lights 208 can be arranged to supply light in a variety of different directions to create different lighting effects. For example, each light 208 can face outwardly away from the base 202 to supply directly outward away from the base 202 (e.g., direct-lit). Alternatively, each light 208 can be positioned along a perimeter of base 202, and can supply light inward, along axes approximately parallel to a seat 214 of the base 202 (e.g., edge-lit). In still other examples, each light 208 may face upward, toward the base 202, which then reflects light downward and away from the retrofit assembly 200 (e.g., back-lit). The light 208 and the driver 210 may be coupled to opposite sides of the base 202. In some embodiments, the retrofit assembly 200 may include a driver mount 212 (e.g., tray, platform, etc.) configured to couple the driver 210 to the base 202 and to space the driver 210 apart from the base 202.

Figure 5A:
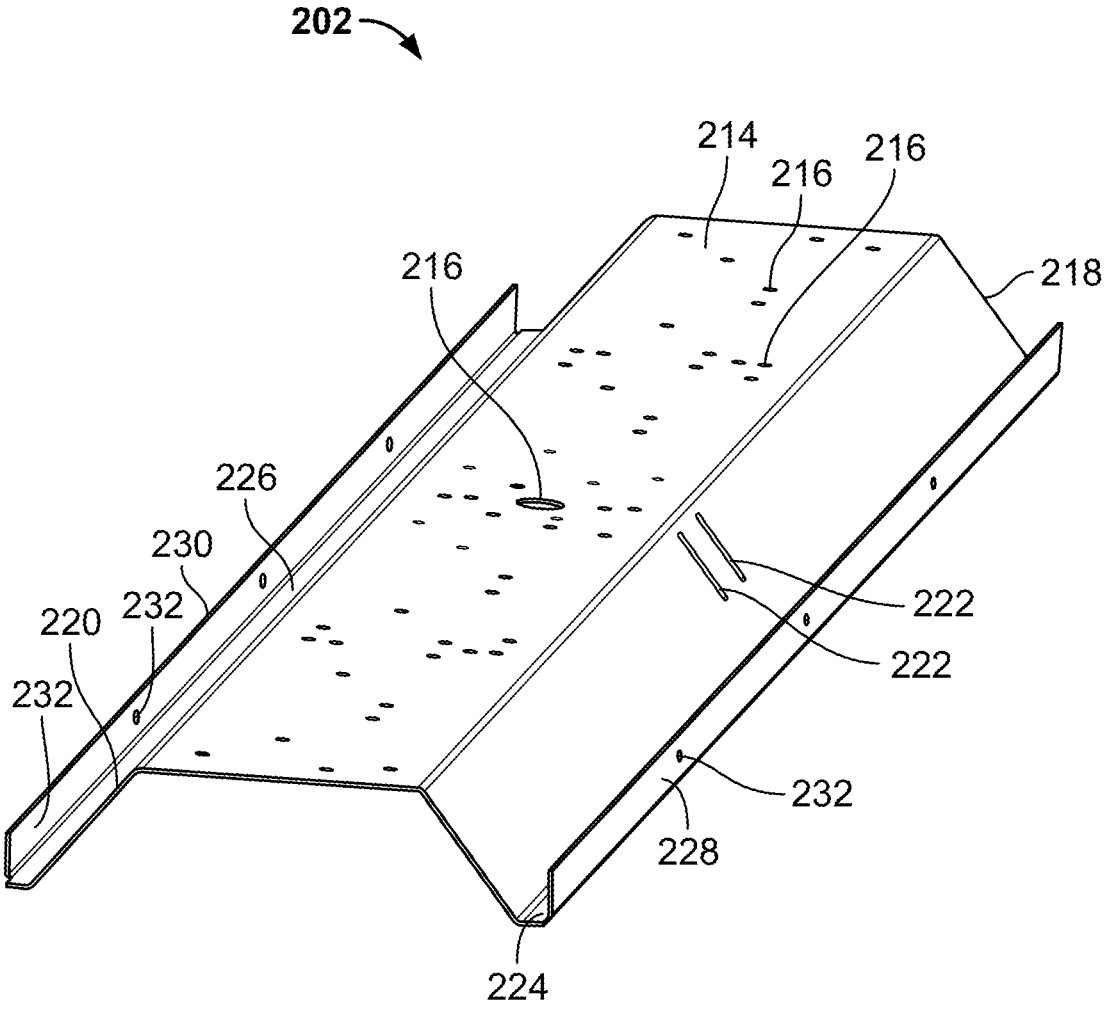
FIG. 5A is a top perspective view of a pan of the retrofit assembly of FIG. 4A.
Figure 5B:
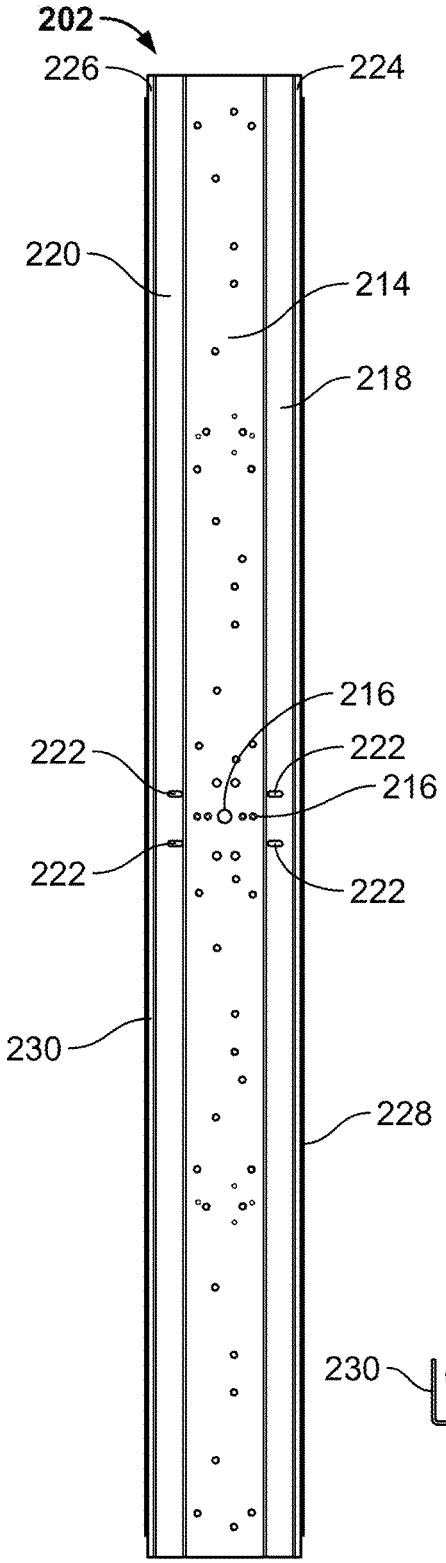
FIG. 5B is a top view of the pan of FIG. 5A.
Figure 5C:
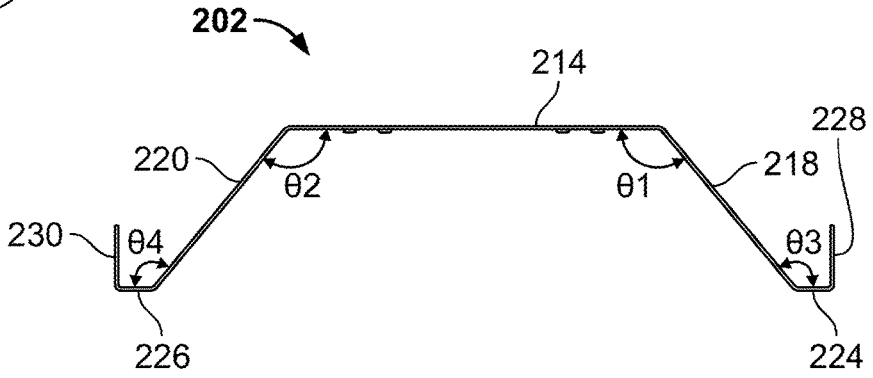
FIG. 5C is a front view of the pan of FIG. 5A.

With additional reference to FIGS. 5A-5C, the base 202 of the pan is further defined. The base 202 substantially occludes (e.g., shields, covers, etc.) the inner surfaces of the housing 102, which helps to prevent light from being reflected of the inner walls of the housing 102 or from passing through any holes in the housing 102 (e.g., toward the ceiling, etc.). The base 202 includes a series of planar segments that can be bent or otherwise formed into a single, continuous piece of sheet metal. The base 202 includes a seat 214 extending along the longitudinal axis X-X. The seat 214 is a generally planar surface having a series of mounting holes 216 extending therethrough. The mounting holes 216 can be configured to receive different fasteners to couple various components of the retrofit assembly 200 together. For example, the light source 204, drivers 210, and driver mount 212 may all be coupled to the seat 214 using fasteners extending through the mounting holes 216.

First and second legs 218, 220 are formed in the base 202, and extend away from the seat 214. In some examples, the first and second legs 218, 220 each extend downwardly and outwardly away from the seat 214 to form obtuse angles θ1, θ2 relative to the seat 214. The angles θ1, θ2 can be between about 100 degrees and about 170 degrees, or between about 105 degrees and about 150 degrees. The angles θ1, θ2 can be approximately equal (e.g., within about 5 degrees or within about 2 degrees) to one another. The first and second legs 218, 220 can each be formed by planar surfaces. Slots 222 can be formed through each of the first and second legs 218, 220. The slots 222 can be positioned within the legs 218, 220 at an axial position approximately centered along the longitudinal axis X-X of the base 202. The slots 222 can be positioned in pairs along the legs 218, 220, spaced apart from one another to receive a bridge (e.g., sensor bridge 254, shown in FIGS. 4A-4C). The slots 222 can extend along a direction generally perpendicular to the longitudinal axis X-X.

First and second feet 224, 226 extend away from the legs 218, 220. Like the seat 214 and the legs 218, 220, the feet 224, 226 are generally planar segments. The first foot 224 extends outwardly away from the first leg 218 at an obtuse angle θ3, while the second foot 226 extends outwardly away from the second leg 220 at an obtuse angle θ4. The angle θ3 can approximately equal to the angle θ1, so that the first foot 224 extends away from the first leg 218 parallel to the seat 214. Similarly, the angle θ4 can be approximately equal to the angle θ2, so that the second foot 226 extends away from the second leg 220 parallel to the seat 214. In some embodiments, each of the angles θ1, θ2, θ3, θ4 are equal to one another. The first leg 218 and the second leg 220 can be similarly sized so that the first foot 224 and second foot 226 are approximately coplanar.

Retaining walls 228, 230 can extend vertically away from each foot 224, 226. In some embodiments, the retaining walls 228, 230 extend orthogonally away from the feet 224, 226, toward the seat 214. The retaining walls 228, 230 can extend upwardly toward the seat 214, to a location about halfway between the feet 224, 226 and the seat 214. The cantilevered nature of the retaining walls 228, 230 can create a spring-like resiliency within the base 202 that can be used to engage or otherwise secure the pan of the retrofit assembly 200 to the outermost surfaces 114 of the outer walls 110 of the housing 102. When the retaining walls 228, 230 extend vertically away from each foot 224, 226, each planar segment within the base 202 is angularly offset from each adjacent planar segment by an angle of at least 80 degrees, and at least about 90 degrees in some examples. Mounting holes 232 can be formed through each of the retaining walls 228, 230 to engage and secure the frame 104 of the housing 102 to the base 202.

The plurality of planar segments defining the base 202 of the pan can be symmetrical across the longitudinal axis X-X. Accordingly, a cross-section of the pan (which can be demonstrated by the front of the base 202) is generally constant along the entire longitudinal axis X-X. Minor variations in the cross-section may exist due to the different mounting hole 216 locations and sizes, but the outer perimeter of the base 202 remains essentially constant throughout the entire component.

The base 202 of the pan can be equipped with various lighting equipment that can be incorporated into the retrofit assembly 200. As indicated above, the base 202 can support a driver assembly formed of a driver 210 and a driver mount 212. The driver 210 is in electrical communication with the light source 204, and is configured to receive power from an external or internal power source (not shown). For example, the driver 210 can be placed in communication with a wall power source (e.g., 120 V AC, 60 Hz) that selectively provides power to the retrofit assembly 200. The driver 210 can be further placed in communication with a sensor (e.g., sensor 256), as discussed in additional detail below.

The driver mount 212 can be coupled to the seat 214 of the base 202, opposite the LED light source, using fasteners extending through the mounting holes 216. The driver mount 212 can support the driver 210 offset from the seat 214 to provide airflow and cooling between the light source 204 and the driver 210. The driver mount 212 and drivers 210 can be positioned along the longitudinal axis X-X of the base 202. In some examples, the driver mount 212 is defined by a length approximately equal to a length of the base 202. The driver mount 212 can be defined by a width less than a width defining the seat 214, measured in a direction perpendicular to the longitudinal axis X-X.

Like the base 202, the driver mount 212 can be a tray defined by a series of planar segments formed by bending a continuous piece of sheet metal into shape. A support surface 234 is formed in the driver mount 212 and, when assembled into the retrofit assembly 200, is spaced apart from the seat 214 of the base 202. The support surface 234 extends approximately parallel (e.g., within 5 degrees) to the seat 214, and includes a plurality of mounting holes 236 that can receive fasteners or equipment to couple the driver 210 or other equipment (e.g., a controller, processor, additional drivers, etc.) to the driver mount 212. Stands 238, 240 extend away from each side of the driver support surface 234. The stands 238, 240 angle away from the driver support surface 234 at obtuse angles that can be approximately equal to one another. Mounting surfaces 242, 244 extend outwardly away from the stands 238, 240, which can be used to couple the driver mount 212 and driver assembly, more generally, to the base 202. The mounting surfaces 242, 244 extend along the seat 214, approximately parallel to the support surface 234. In some embodiments, wings 246, 248 extend upwardly and outwardly away from the mounting surfaces 242, 244. As depicted, the driver mount 212 can have a W-shaped configuration.

The lens 206 can be mounted to the base 202 as well. The lens 206 can surround a portion of the light source 204, and extends away from two different points along the seat 214 in a convex shape. The lens 206 is configured to help distribute light and to shield the light source 204. According to an exemplary embodiment, the lens 206 is formed from a substantially rectangular piece of semi-transparent material (e.g., plastic, etc.). The lens 206 is engaged with two interface members, shown as lens brackets 250. The lens brackets 250 can be mounted to the underside of the seat 214 using fasteners 252. When engaged with the base 202 at the lens brackets 250, the lens 206 forms a dome shape. In some embodiments, the lens brackets 250 extend along the entirety of the seat 214, while in other examples, multiple lenses 206 and four or more lens brackets 250 extend partially along a length of the base 202.

Figure 4A:
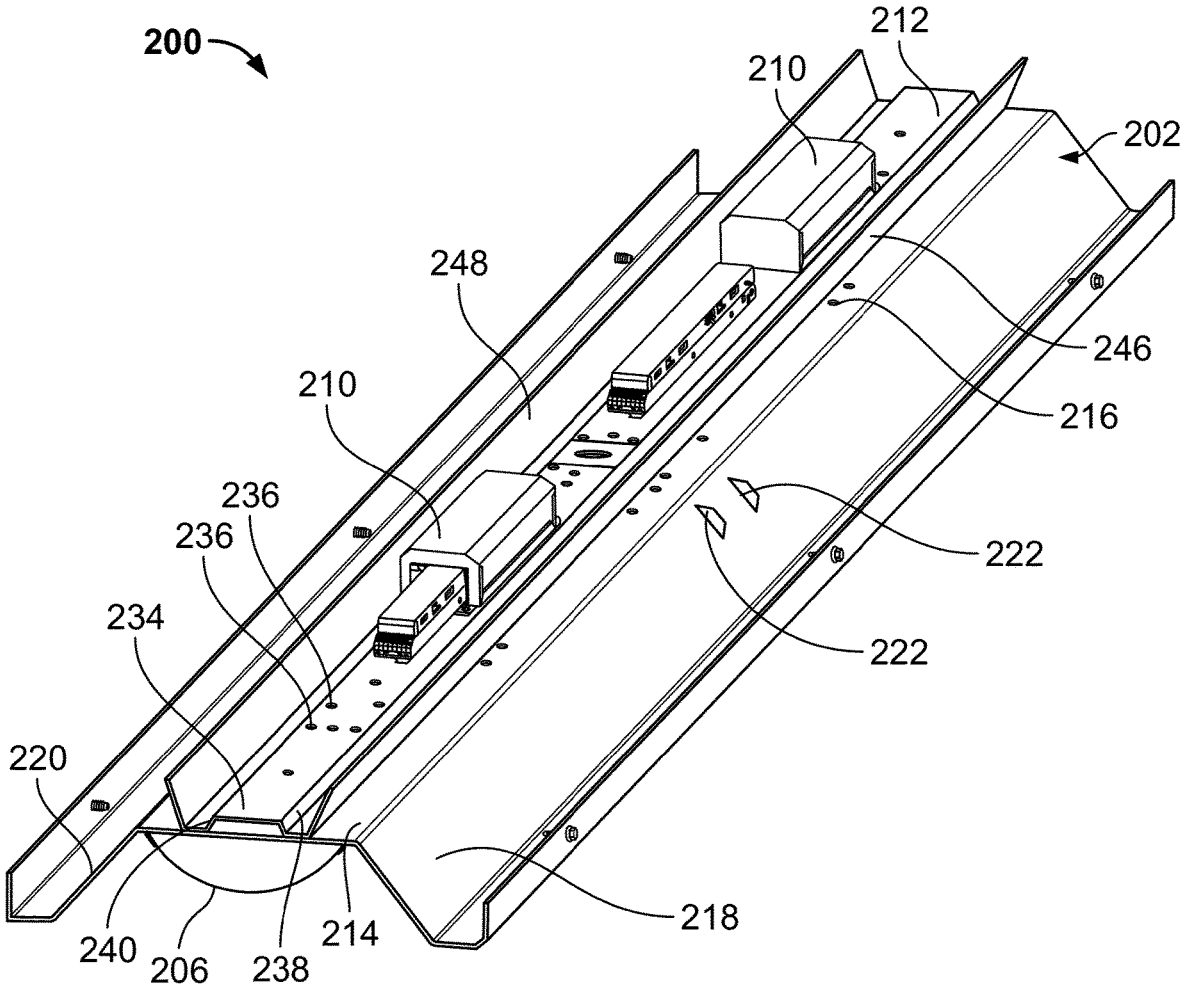
FIG. 4A is a top perspective view of the retrofit assembly of FIG. 3A, shown isolated from the existing housing.
Figure 4B:
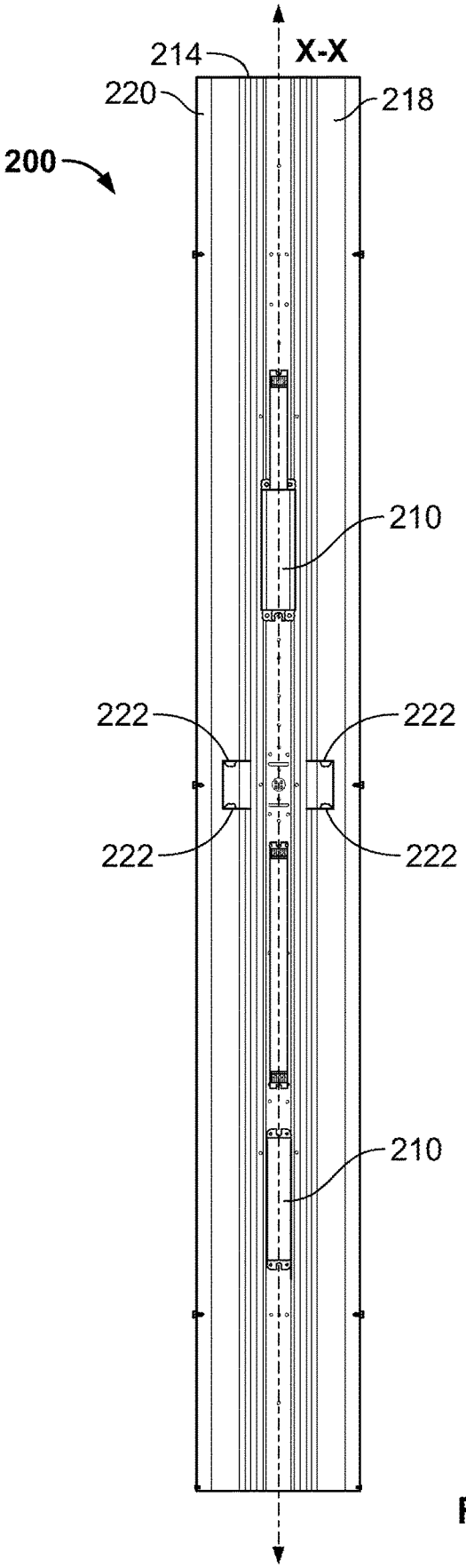
FIG. 4B is a top view of the retrofit assembly of FIG. 4A.
Figure 4C:
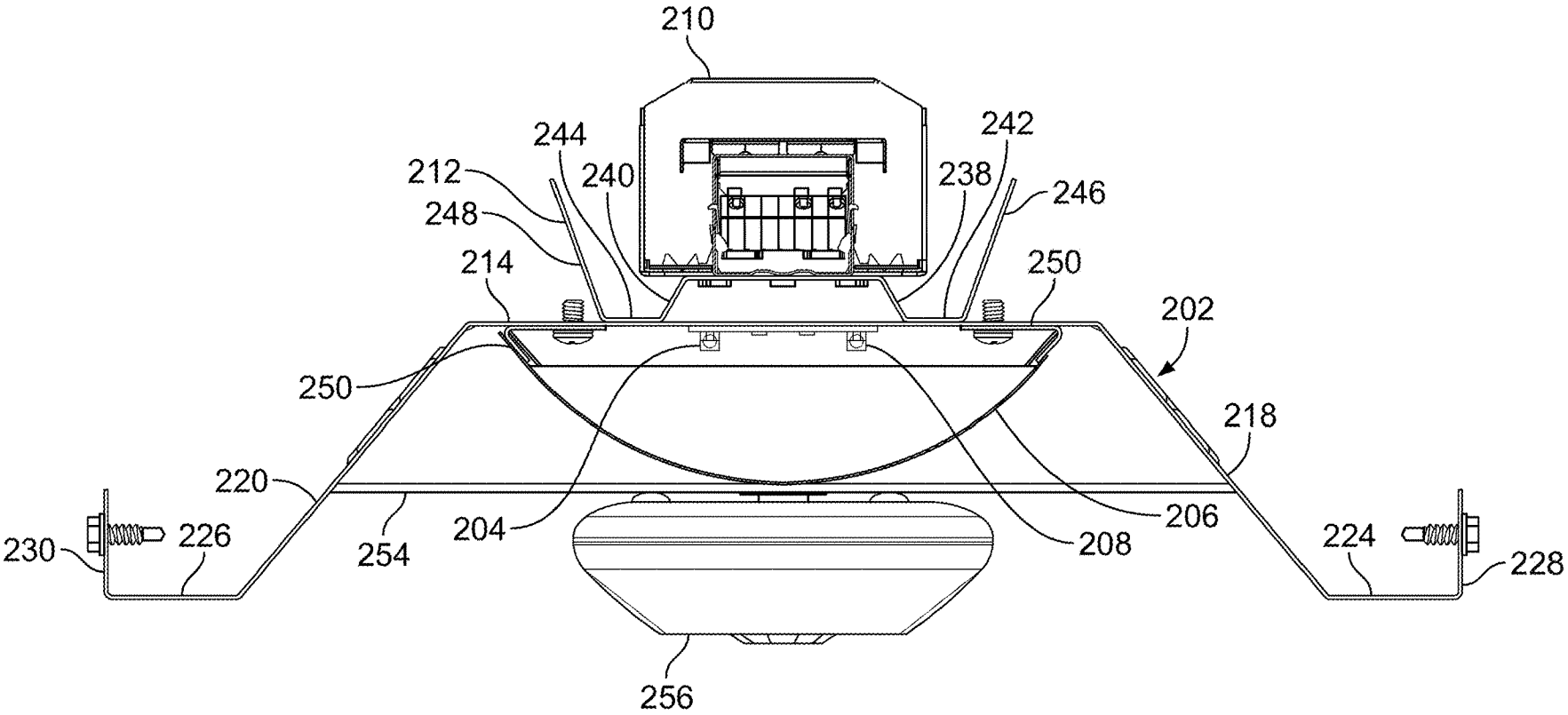
FIG. 4C is a front view of the retrofit assembly of FIG. 4A.

In some embodiments, the retrofit assembly 200 includes multiple light sources 204, lenses 206, lights 208, and drivers 210. As depicted in FIGS. 3B, 4A, and 4B, the retrofit assembly 200 can include two drivers 210 separately mounted to the driver mount 212. The two drivers 210 separately control the power supply to two different light sources 204 and lights 208. A separate lens 206 can be used to surround each separate light or set of lights 208.

Each light source 204 and light (or set of lights) 208 can be separated from one another by a bridge 254. The bridge 254 can be coupled to the base 202 and can extend from the first leg 218, across the seat 214, to the second leg 220, and can define a sensor mounting surface that extends approximately parallel to the seat 214. The bridge 254 can be a polymeric or metallic, for example, and can support a sensor 256. The sensor 256 can be a motion sensor or an ambient light sensor, for example, which monitors the surroundings and detects the presence of conditions that may determine whether the light source 204 and lights 208 should be operating. Upon detection of a condition (e.g., motion), the sensor 256 can issue a command to the one or more drivers 210 to supply power to the light sources 204 to activate or otherwise alter an operational state of the lights 208. In some embodiments, the bridge 254 supports a controller, which can be placed in communication with the sensor and one or more light source 204. The controller can receive a signal from the sensor 256 (e.g., a signal conveying that a monitored condition was sensed) and activate or otherwise supply power to the light sources 204 to alter an operational state of the lights 208.

The bridge 254 is configured to couple the sensor 256 to the base 202. As shown in FIG. 4A, the bridge 254 includes one or more flexible tabs 258 configured to engage with slots 222 or openings in the base 202. The tabs 258 may be bent onto or resiliently engaged with a surface of the base 202 to secure the bridge 254 in position relative to the base 202. A mounting position (e.g., a longitudinal position, a position along a centerline of the existing housing, etc.) of the bridge 254 and sensor 256 relative to the base 202 may be modified to accommodate different light fixtures. In some examples, the bridge 254 is approximately centered along the longitudinal axis X-X of the base 202. Two sets of lens brackets 250 can be coupled to the seat 214 to support two separate lenses 206, which can extend from an end of the base 202 to the bridge 254. Accordingly, the retrofit assembly 200 can be substantially symmetrical about the longitudinal axis X-X and a latitudinal axis Y-Y.

The retrofit assembly 200 can be installed into the housing 102 to create the lighting assembly 100', as depicted in FIGS. 3A-3C. After the previous light fixture and wiring have been removed from the cavity 106, the new retrofit assembly 200 can be urged into the cavity 106. The retrofit assembly 200 can be raised into the cavity 106 until the frame 104 bottoms out on the feet 224, 226 of the base 202. The base 202 is sized and adapted so that a tight clearance fit is formed between the retaining walls 228, 230 and the outermost surfaces 114 of the outer walls 110. The retaining walls 228, 230 can act as guides to help promote the installation of the retrofit assembly 200 into the frame 104 as well. The retaining walls 228, 230 each extend approximately parallel to each of the outermost surfaces 114 so that flush metal-to-metal contact is created along the entire longitudinal axis X-X of the base 202, outside of the frame 104. Once the retaining walls 228, 230 are surrounding the frame 104, fasteners 260 can be passed through the mounting holes 232 in the retaining walls 228, 230 and through the outer walls 110 to couple and secure the retrofit assembly 200 to the housing 102 to create the improved lighting assembly 100'.

Various arrangements of the retrofit assembly 200', 200" are possible without departing from the inventive principles described herein. As shown in FIGS. 6A-11C, a shape of the base 202, and therefore the retrofit assembly 200' may be modified to accommodate housings 102 of different lengths and shapes. The number and/or placement of light sources 204 may also vary in different exemplary embodiments. The types of fasteners used to couple the retrofit assemblies 200', 200" to the housing 102 (e.g., clips instead of bolts) can be adjusted to accommodate a wider range of housing 102 sizes and shapes as well.

Different housings 102, 102', 102" can be accommodated by adjusting the shape of the base 202 of the pan. For example, when the depth of the housing 102' is reduced, the angles θ1, θ2, θ3, θ4 can be adjusted. Increasing the angles θ1, θ2, θ3, θ4 alters the base 202' to have a narrower seat 214', wider legs 218', 220', and a decreased depth (e.g., decreased distance between the seat 214' and the feet 224', 226') than the base 202, which may be useful on certain types of housings 102'. In some examples, the heights of the retaining walls 228', 230' can be adjusted as well. When smaller retaining wall 228', 230' heights are used, different types of fasteners 302 can be used to couple the retrofit assemblies 200' to the housing 102'.

As shown in FIGS. 6C-6F, clips 302 can be used in conjunction with a screw 304 and nut 306 can pinch the outer walls 110' of the frame 104' together with the retaining walls 228', 230' to secure the retrofit assembly 200' to the housing 102'. The clip 302 can have a U-shape that defines a cavity 308 that can receive a portion of both the retaining wall 228', 230' and the outer wall 110'. A screw 304 can extend through a hole formed in the retaining walls 228', 230', the outer wall 110', and each leg 310, 312 of the clip 302. A nut 306 can be threaded onto the screw 304. Threading the nut 306 onto the screw 304 and engaging the clip 302 flexes the legs 310, 312 inward, so that the legs 310, 312 tightly grasp and engage one of the retaining walls 228', 230' and the outer wall 110' to hold the retrofit assembly 200' securely within the housing 102 to create another lighting assembly 100". The clips 302 can be spaced apart the longitudinal axis X-X of the base 202' to more evenly distribute the clamping forces used to keep the retrofit assembly 200' secured to the housing 102'.

Figure 6A:
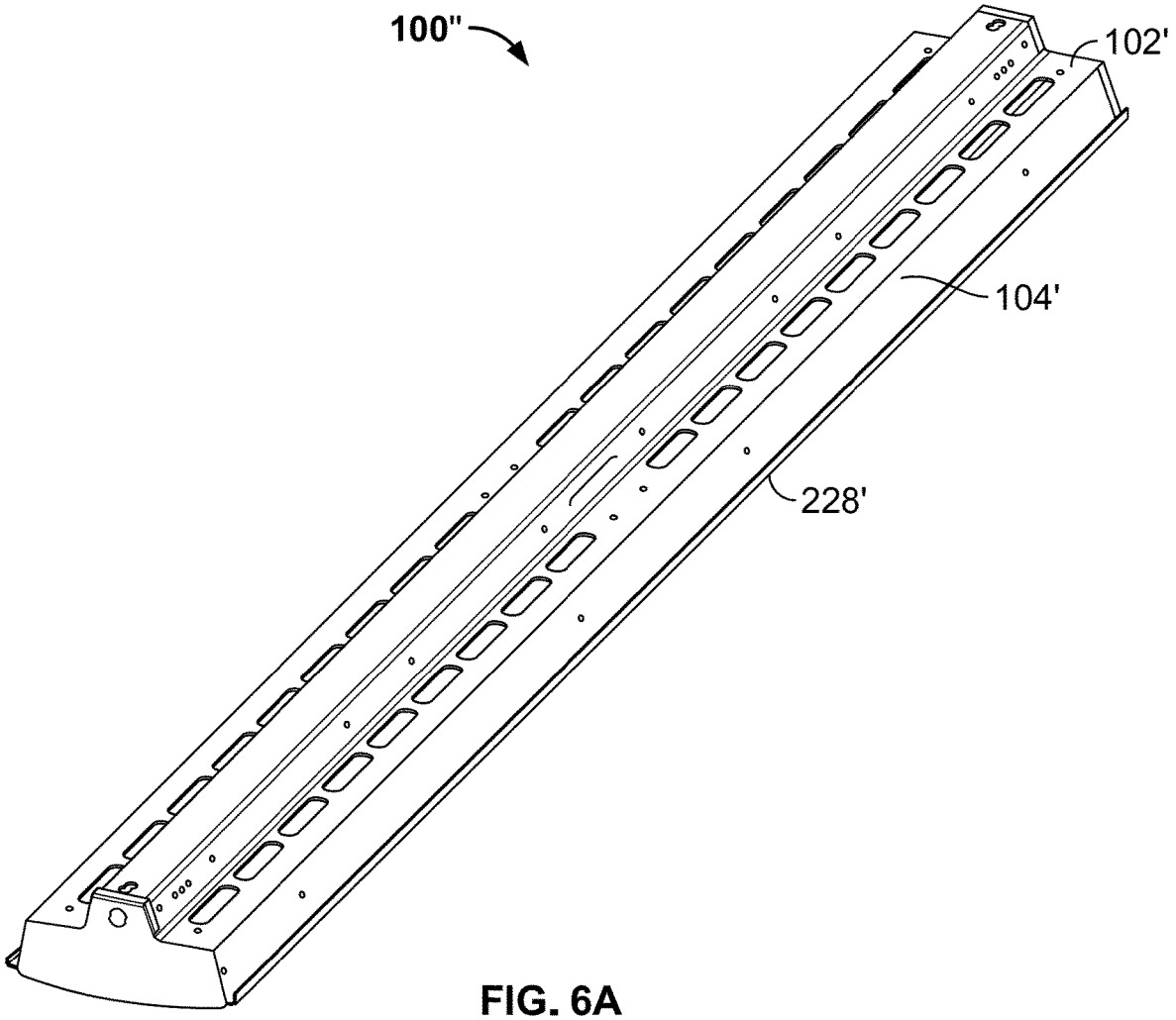
FIG. 6A is a top perspective view of another existing housing incorporating a retrofit assembly, according to another exemplary embodiment.
Figure 6B:
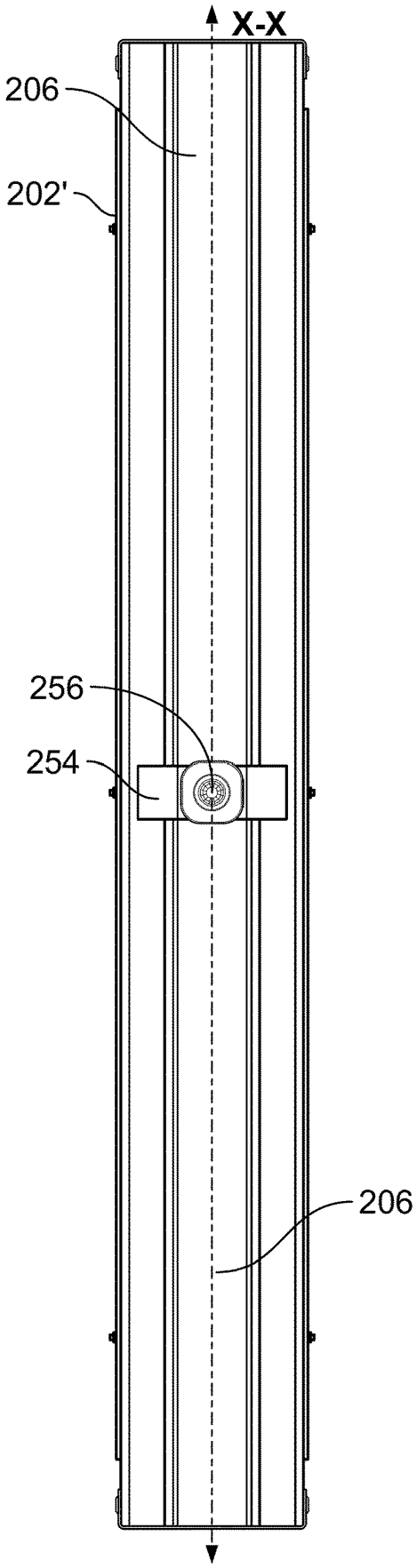
FIG. 6B is a bottom view of the retrofit assembly of FIG. 6A.
Figure 6C:
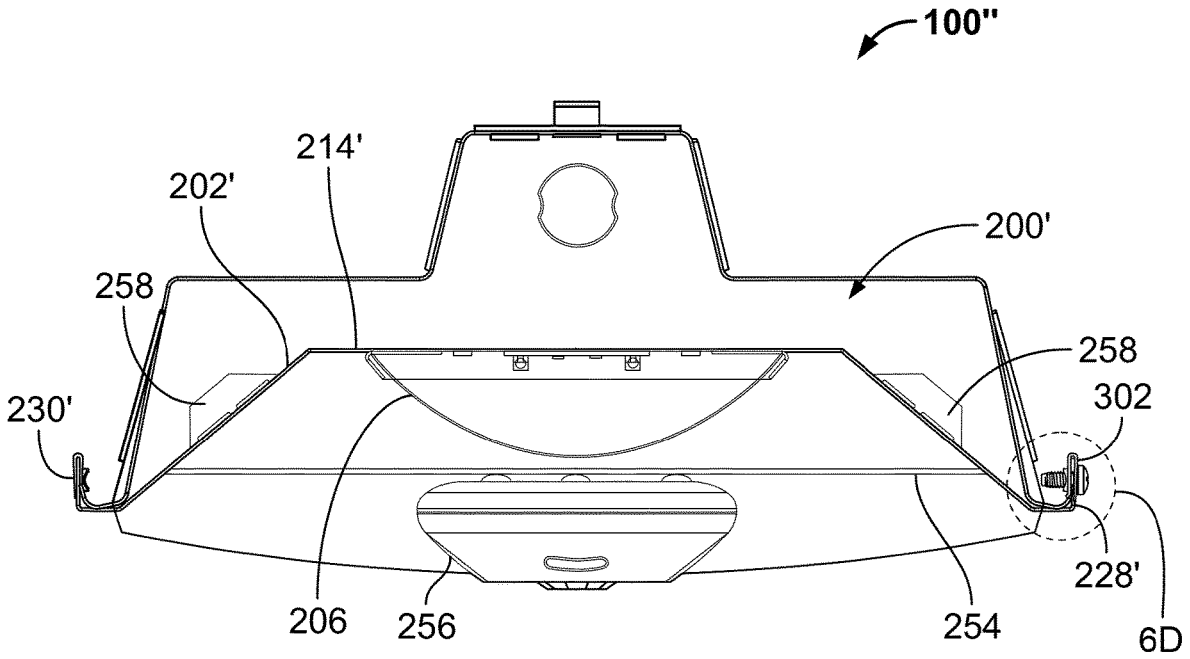
FIG. 6C is a front view of the retrofit assembly of FIG. 6A, with a cover removed for clarity.
Figure 6D:
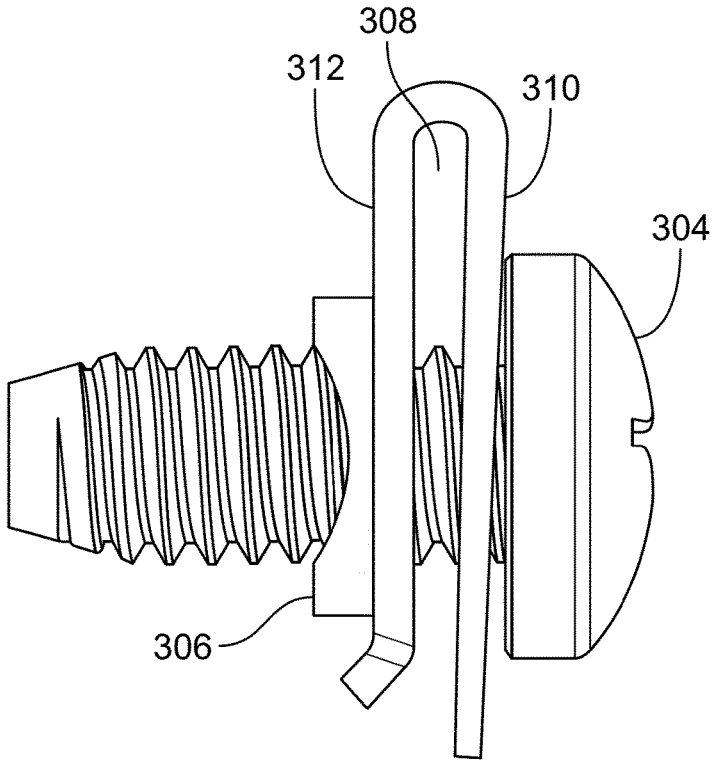
FIG. 6D is a detail view of a mounting clip that is used to mount the retrofit assembly to the existing housing, taken from the area within the dashed line 6D in FIG. 6C.
Figure 6F:
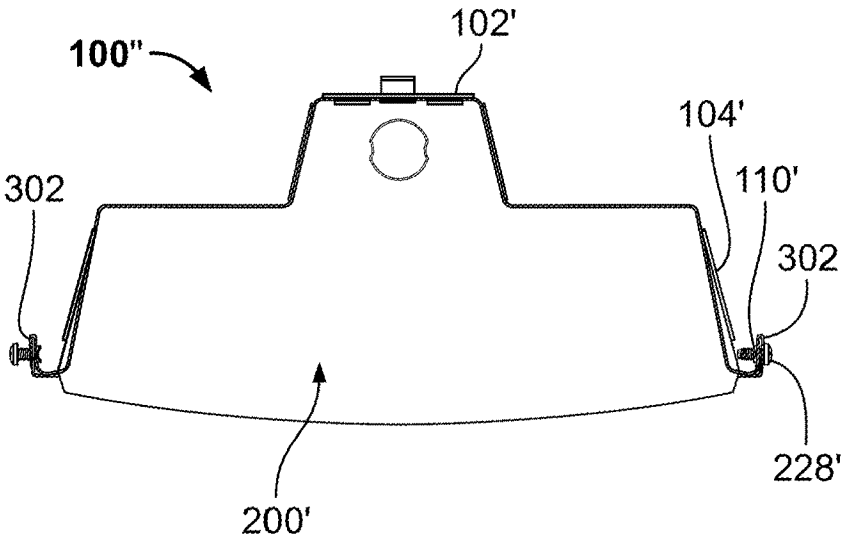
FIG. 6F is a front view of the retrofit assembly of FIG. 6E rotated into engagement with the existing housing of FIG. 6A.

The clips 302 and base 202' can create a temporary hinged coupling between the retrofit assembly 200' and housing 102' to help facilitate the installation process. To begin the installation process, clips 302 can be secured to one side of the retrofit assembly 200' and housing 102'. As shown in FIG. 6D, for example, clips 302 can be positioned around and secured to the first retaining wall 228' and an outer wall 110 of the frame 104 of the housing 102' by passing the screw 304 through holes 232 and additional holes (not shown) formed in the outer wall 110' of the frame 104' and securing the nut 306 into engagement with the screw 304.

Figure 6E:
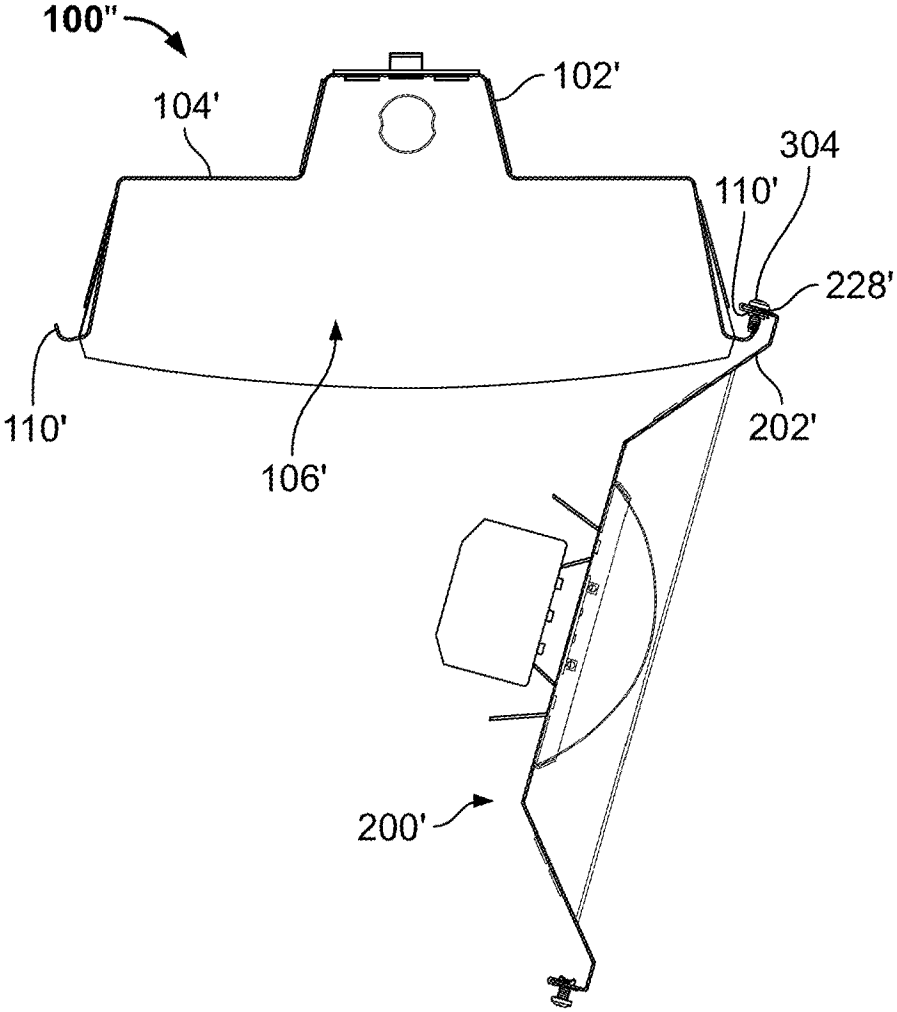
FIG. 6E is a front view of the retrofit assembly of FIG. 6A in a partially-installed position relative to the existing housing.
Figure 7A:
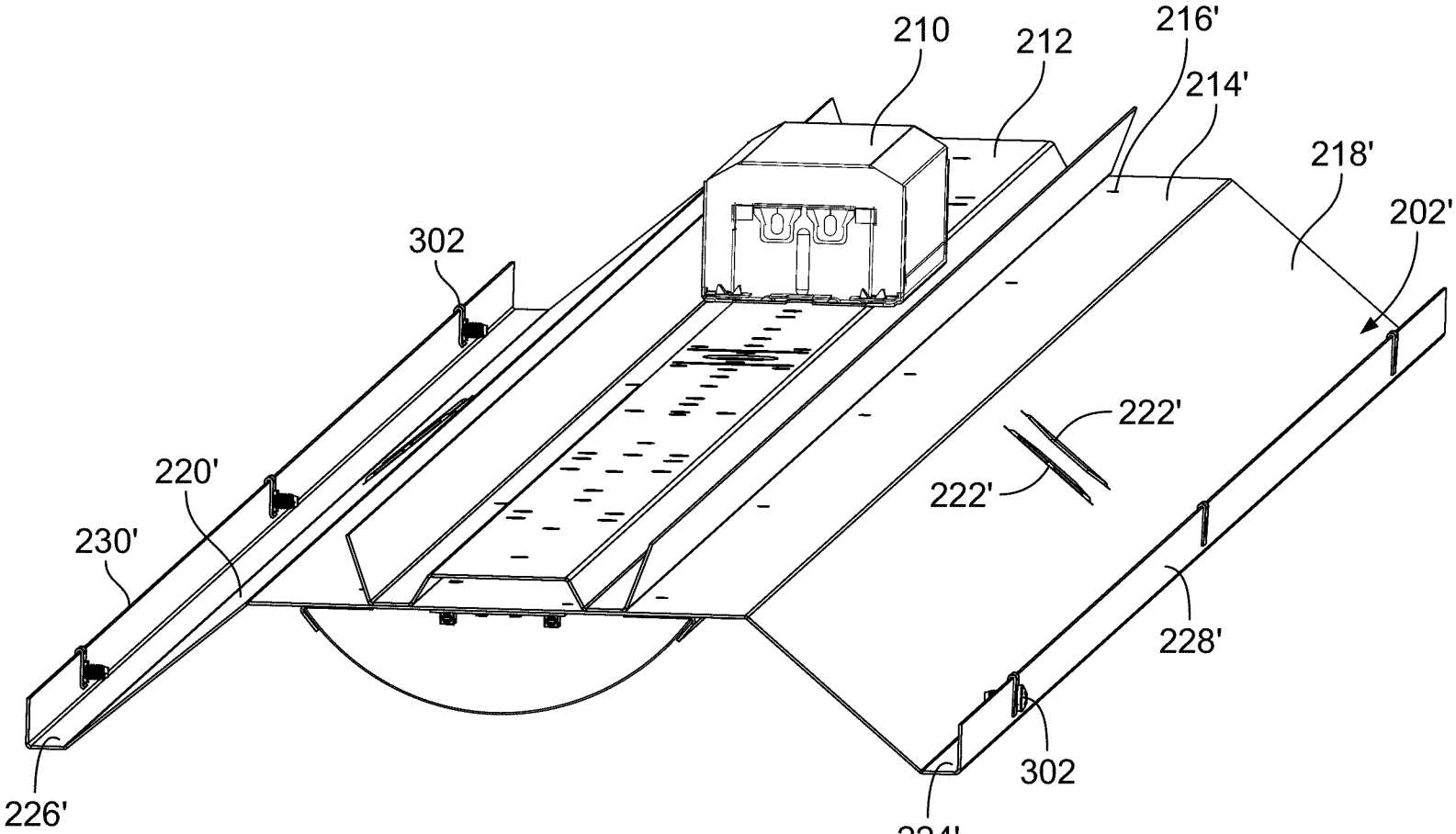
FIG. 7A is a top perspective view of the retrofit assembly of FIG. 6A, shown isolated from the existing housing.
Figure 7C:
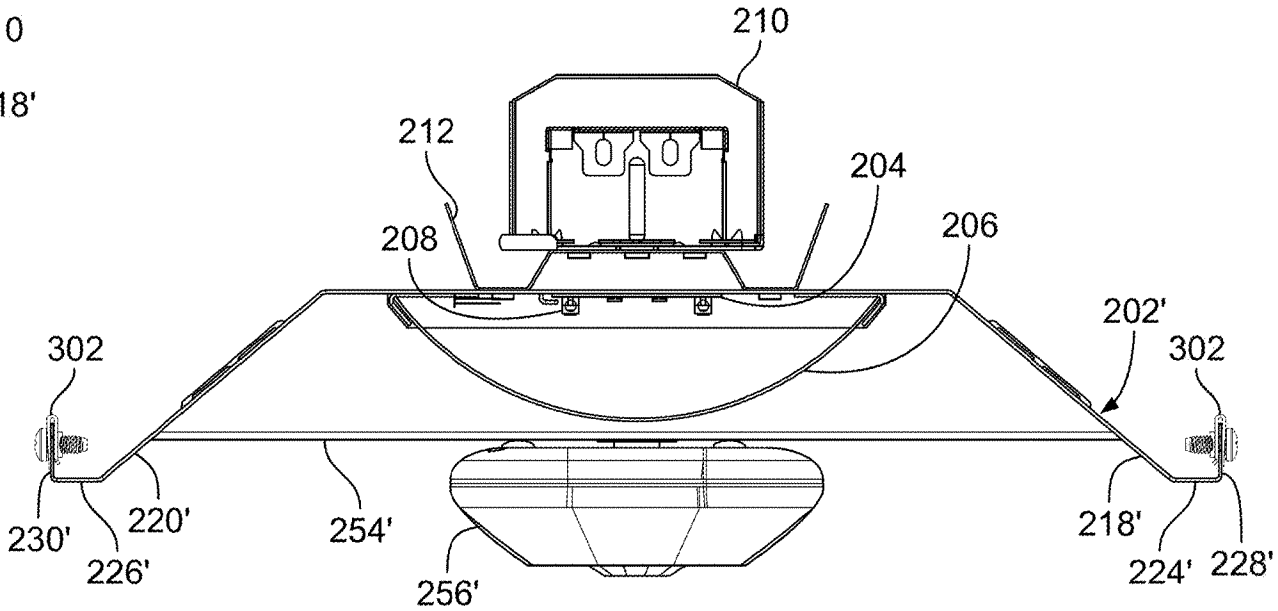
FIG. 7C is a front view of the retrofit assembly of FIG. 7A.
Figure 7B:
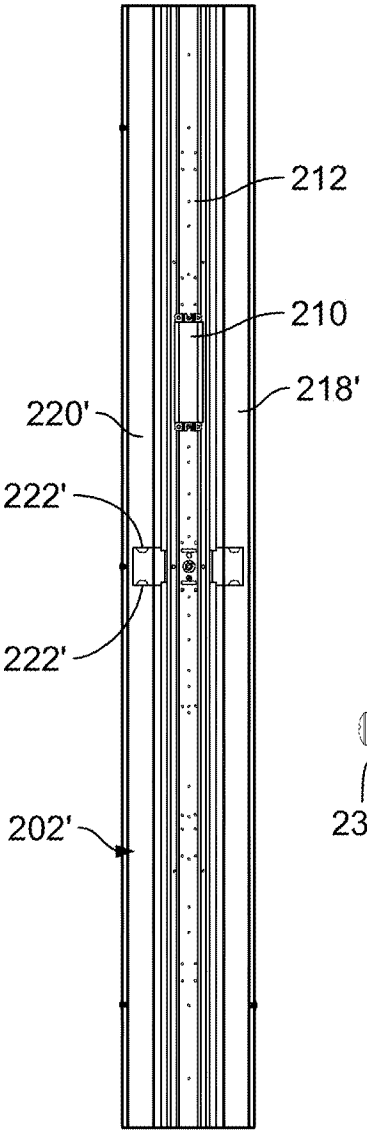
FIG. 7B is a top view of the retrofit assembly of FIG. 7A.
Figure 8A:
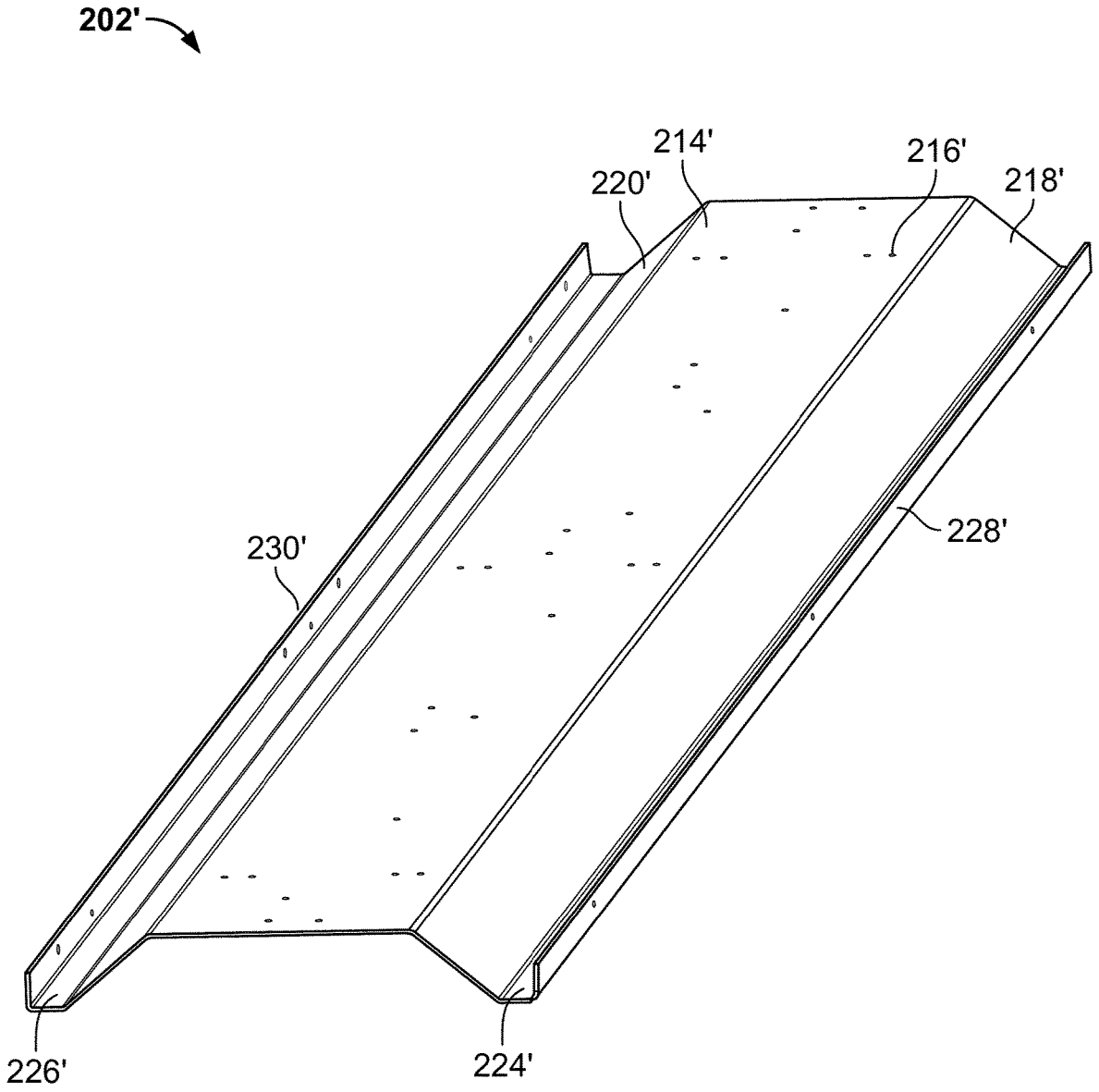
FIG. 8A is a top perspective view of a pan of the retrofit assembly of FIG. 7A.
Figure 8C:
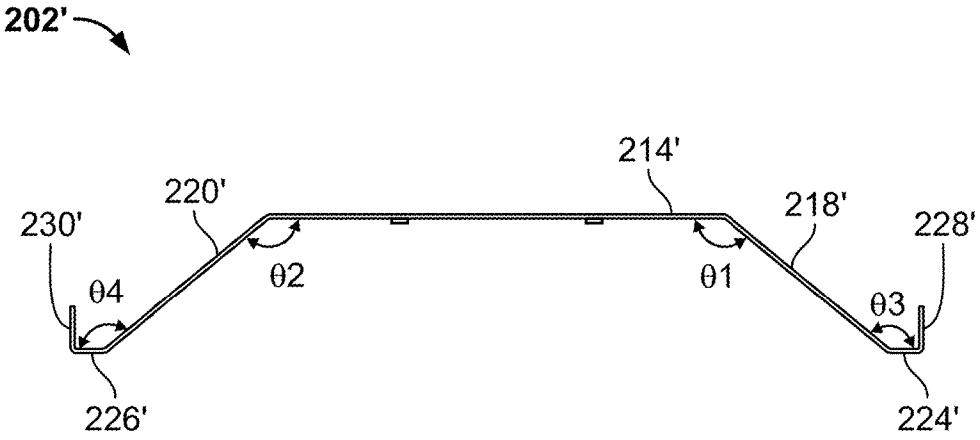
FIG. 8C is a front view of the pan of FIG. 8A.
Figure 8B:
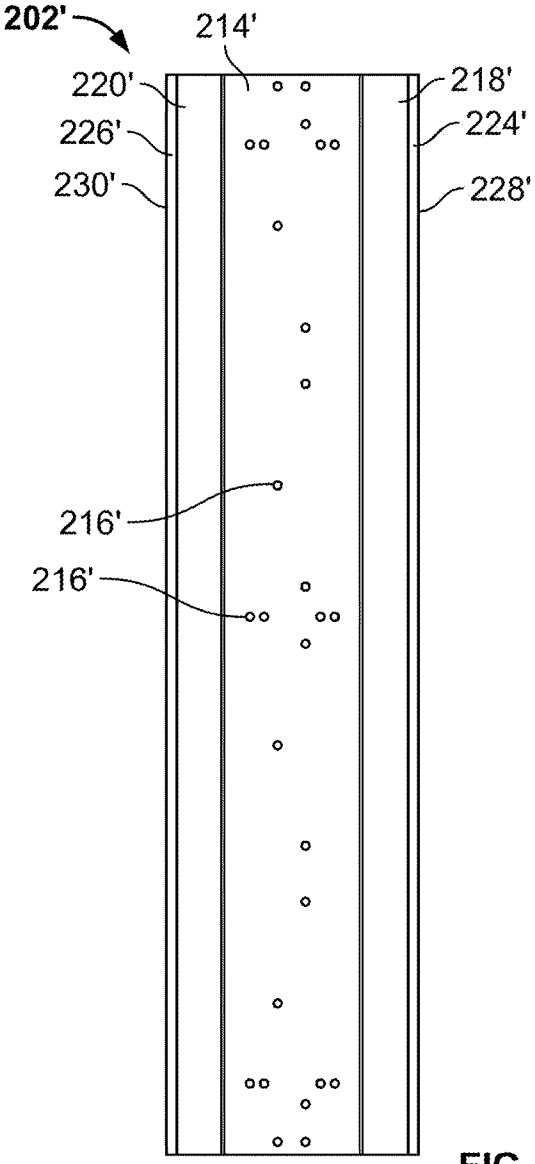
FIG. 8B is a top view of the pan of FIG. 8A.
Figure 9A:
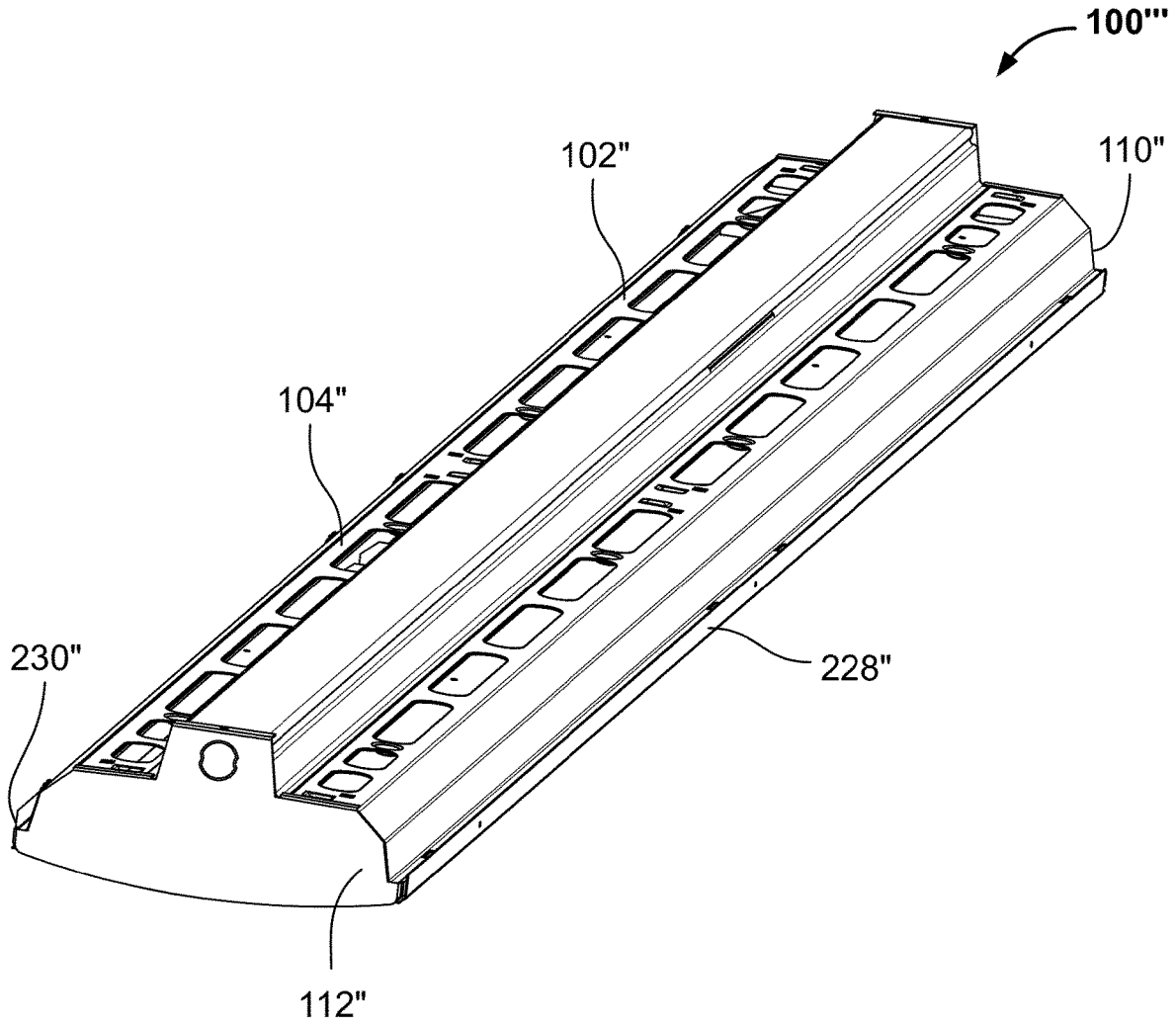
FIG. 9A is a top perspective view of an existing housing incorporating a retrofit assembly, according to another exemplary embodiment.
Figure 9B:
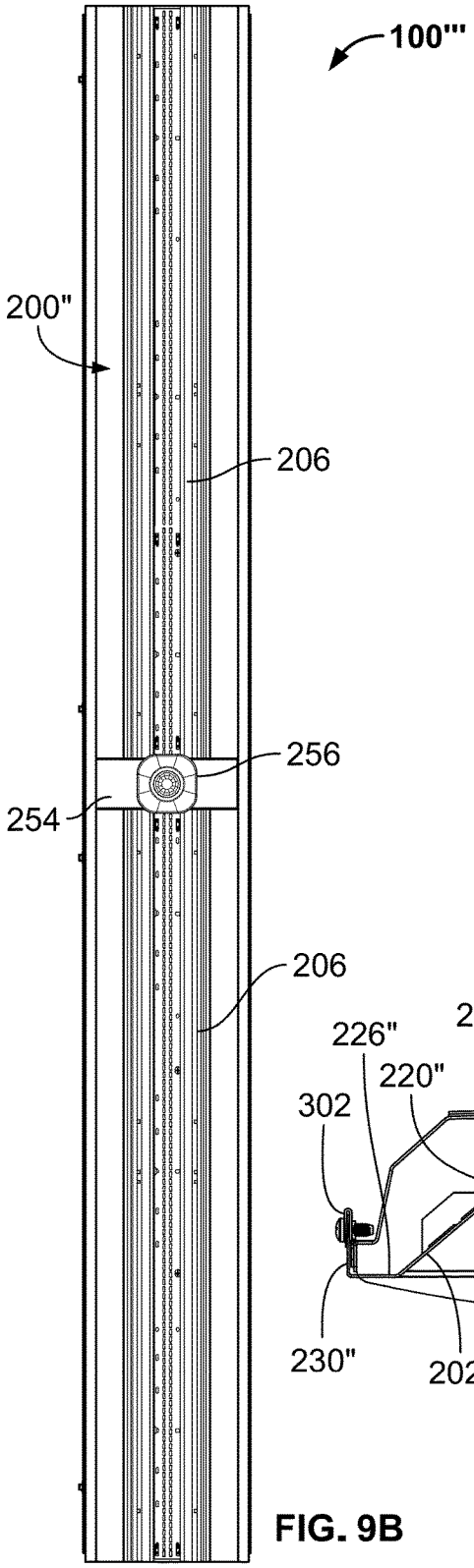
FIG. 9B is a bottom view of the retrofit assembly of FIG. 9A.
Figure 9C:
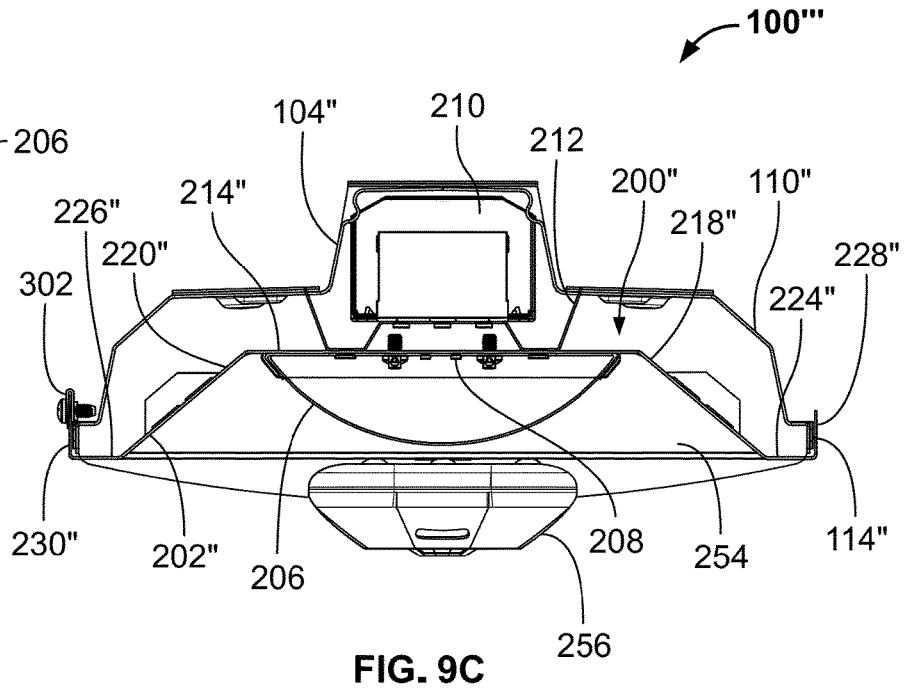
FIG. 9C is a front view of the retrofit assembly of FIG. 9A, with a cover removed for clarity.
Figure 10B:
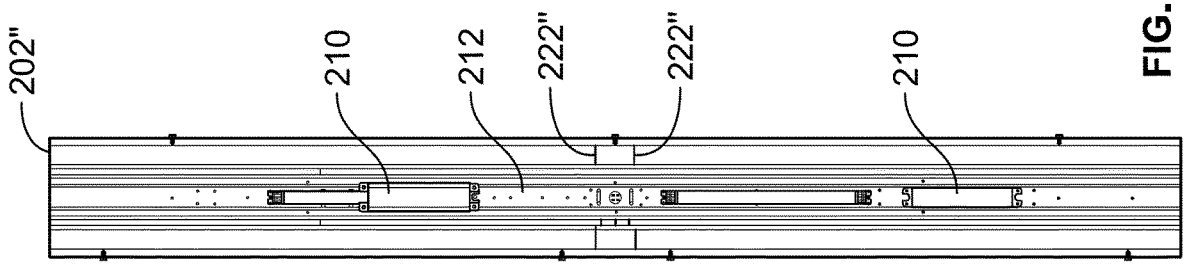
FIG. 10B is a top view of the retrofit assembly of FIG. 10A.
Figure 10A:
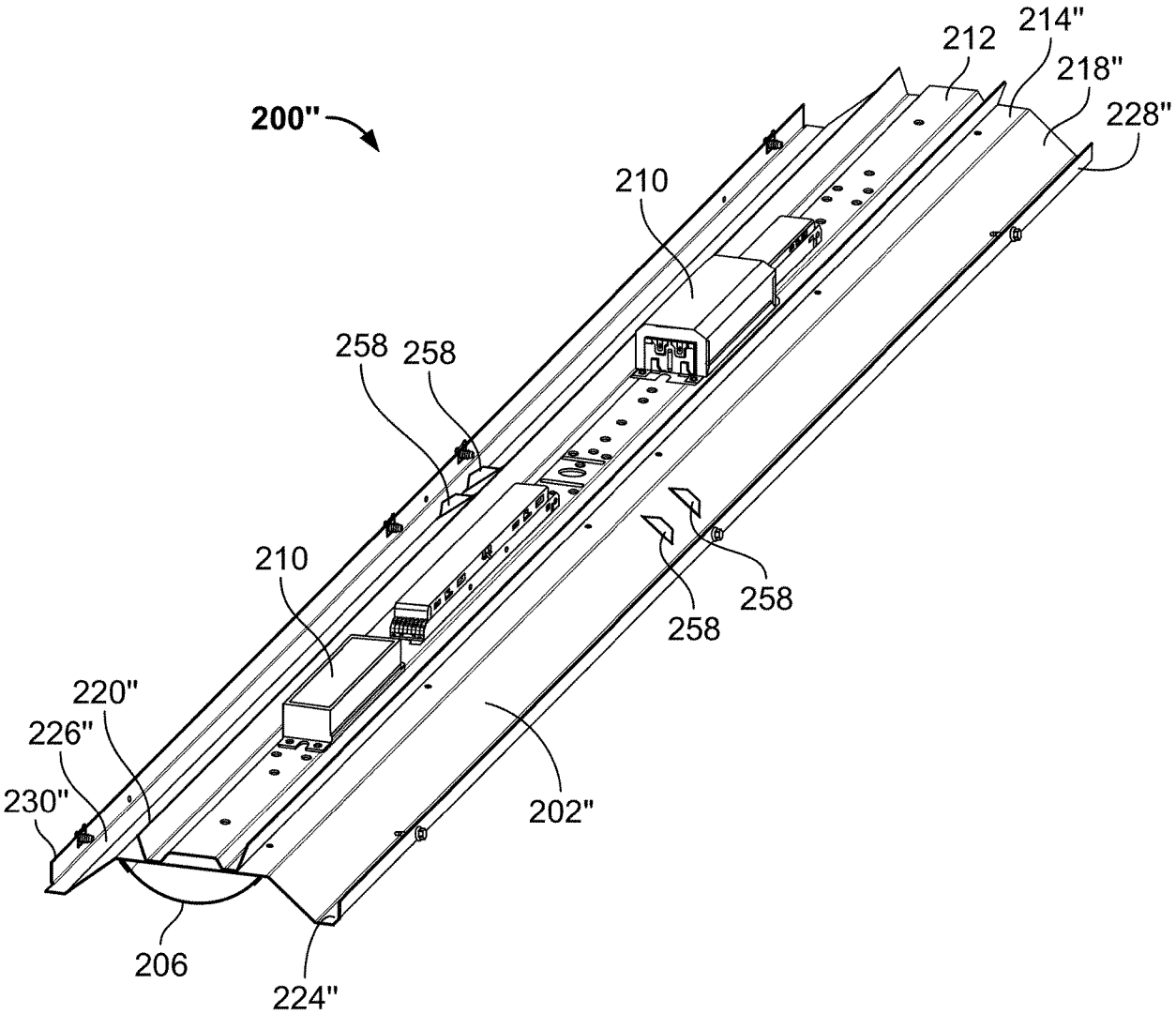
FIG. 10A is a top perspective view of the retrofit assembly of FIG. 9A, shown isolated from the existing housing.
Figure 10C:
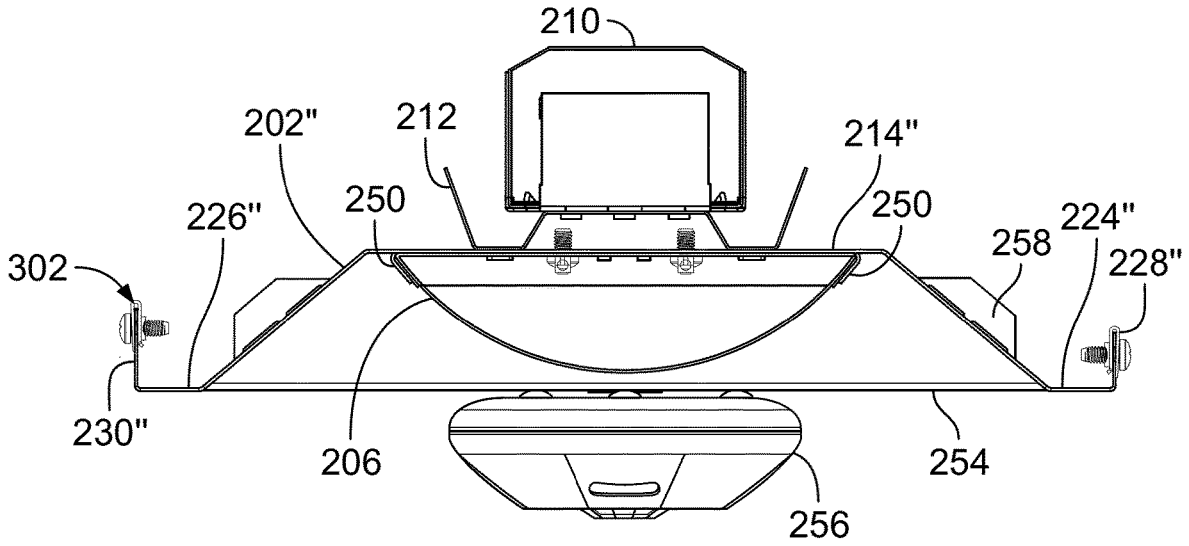
FIG. 10C is a front view of the retrofit assembly of FIG. 10A.
Figure 11A:
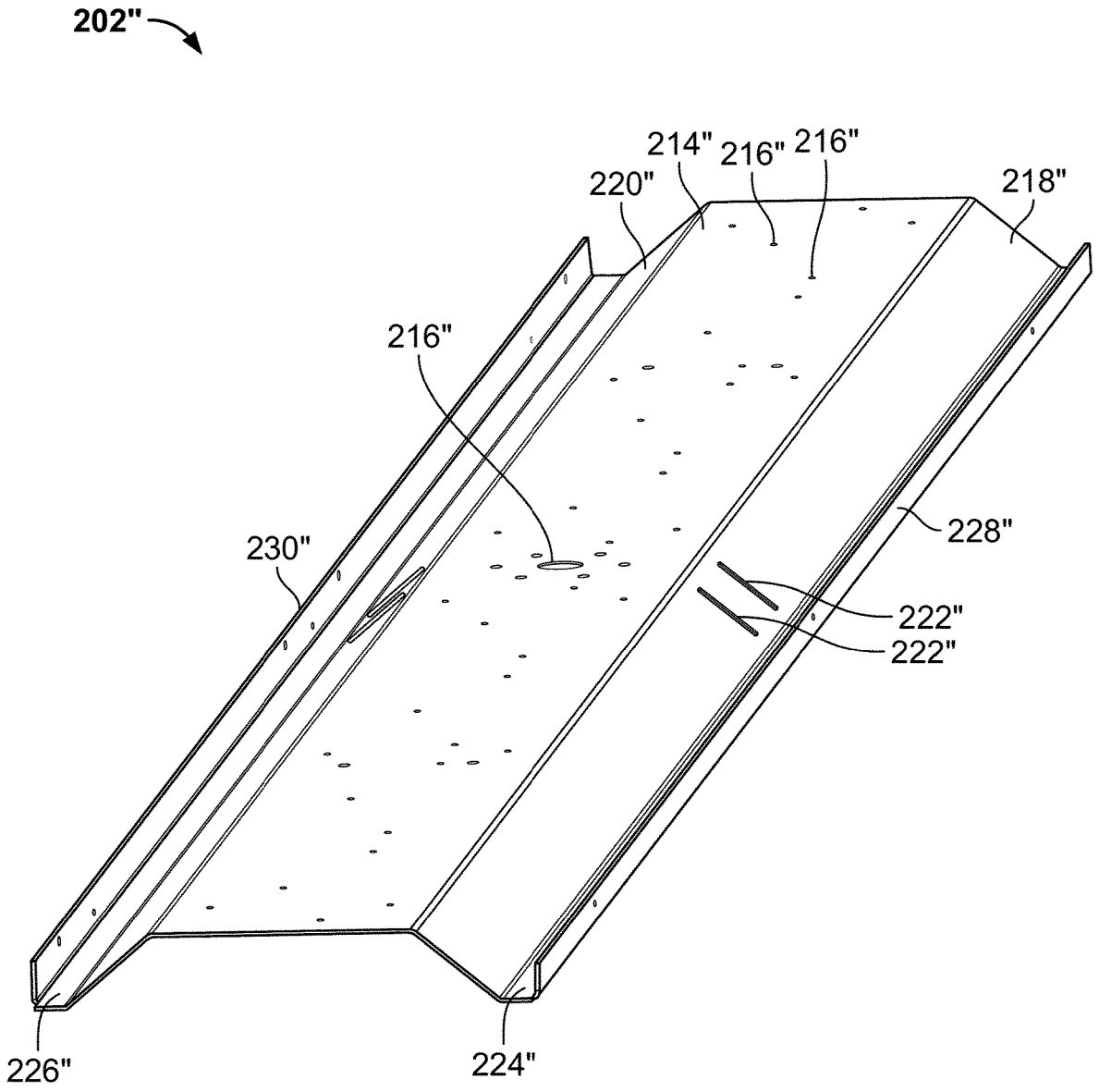
FIG. 11A is a top perspective view of a pan of the retrofit assembly of FIG. 10A.
Figure 11C:
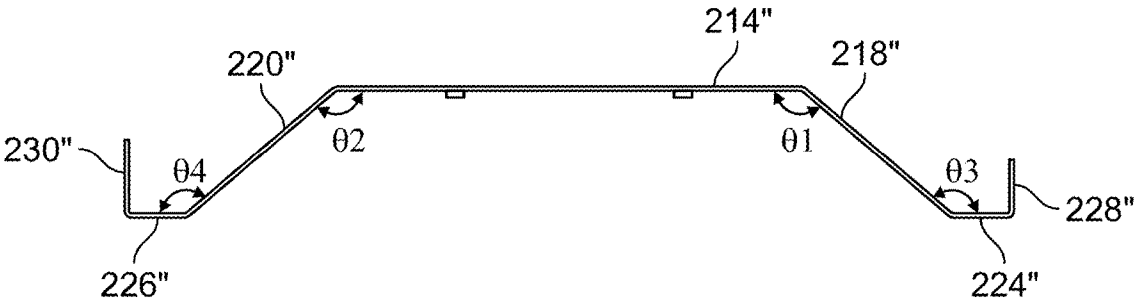
FIG. 11C is a front view of the pan of FIG. 11A.
Figure 11B:
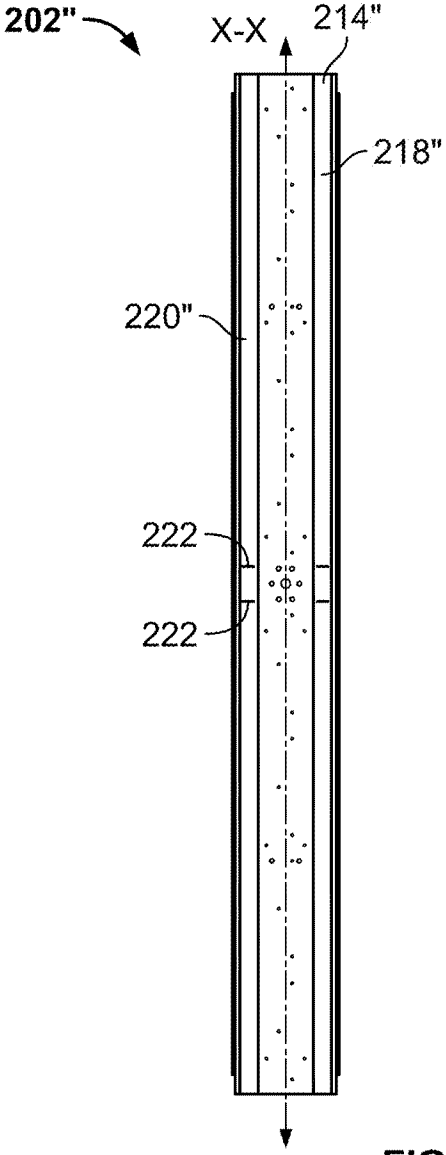
FIG. 11B is a top view of the pan of FIG. 11A.

The resilient nature of the frame 104' and base 202' allows the entire retrofit assembly 200' to rotate about the joint created by the clips 302, which can promote easier installation. As shown in FIG. 6E, gravity causes the retrofit assembly 200' to swing downwardly away from the clips 302, allowing access into the cavity 106 of the housing 102'. With the retrofit assembly 200' swung open, a worker can quickly and easily create wire couplings between the retrofit assembly 200' and electrical equipment (e.g., a power source, a controller, etc.) present within the cavity 106 or housing 102' in order to facilitate operation of the retrofit assembly 200'. Once the necessary electrical connections have been created, the retrofit assembly 200' can be rotated upward, so that the second retaining wall 230' engages the outer wall 110' on the opposite side of the frame 104'. Additional clips 302 can then secure the entire retrofit assembly 200' in the fully-installed position, shown in FIG. 6F. In some embodiments, the retaining walls 228, 230 can be bent into a shape that secures the retrofit assembly 200, 200', 200" to the outer walls 110, 110', 110" of the frame 104, 104', 104", creating a similar hinge-like joint to promote easier installation.

Still further adjustments and alterations can be made to the base 202 to accommodate different housings 102, 102', 102". For example, the seat 214" can be widened out to support additional lights 208. As shown in FIGS. 9A-11C, the retaining walls 228", 230" can be lengthened to accommodate frames 104" having larger outer walls 110" and outermost surfaces 114". The feet 224", 226" can be widened out as well, which can allow different depths of base 202" to be used, along with a driver 210 and driver mount 212 uniform across each embodiment. In each example, a portion of the base 202, 202', 202" extends outward beyond the outer perimeter of the frame 104, 104', 104". The retaining walls 228, 228', 228", 230, 230', 230" each extend upward from, and in some cases parallel to, the outermost surfaces 114, 114', 114" of the outer walls 110, 110', 110" of the housing 102, 102', 102". The retrofit assemblies 200, 200', 200" can then be fit over each existing housing 102, 102', 102" and secured in place using fasteners or adaptors (e.g., clips, clamps, etc.) to provide a more powerful and more efficient lighting assembly 100', 100", 100'" than the existing lighting assembly 100.

As shown in FIGS. 12A-12D, adaptor clips 400 can be used to facilitate the installation of the same retrofit assembly (e.g., retrofit assembly 200') into different housings 102, 102', 102". The adaptor clip 400 includes a hook 402 and tab 404 extending away from the hook 402. The hook 402 can be formed of a series of bends that extend away from a generally planar surface 406 formed adjacent the tab 404. The hook 402 defines a concave surface 408 that curves downwardly and outwardly away from the planar surface 406, to a distal wall 410. The tab 404 includes two mounting sections 412, 414 that together form a retaining channel 416. The mounting sections can angle away from one another at an angle of between about 60 degrees and about 150 degrees.

Figure 12B:
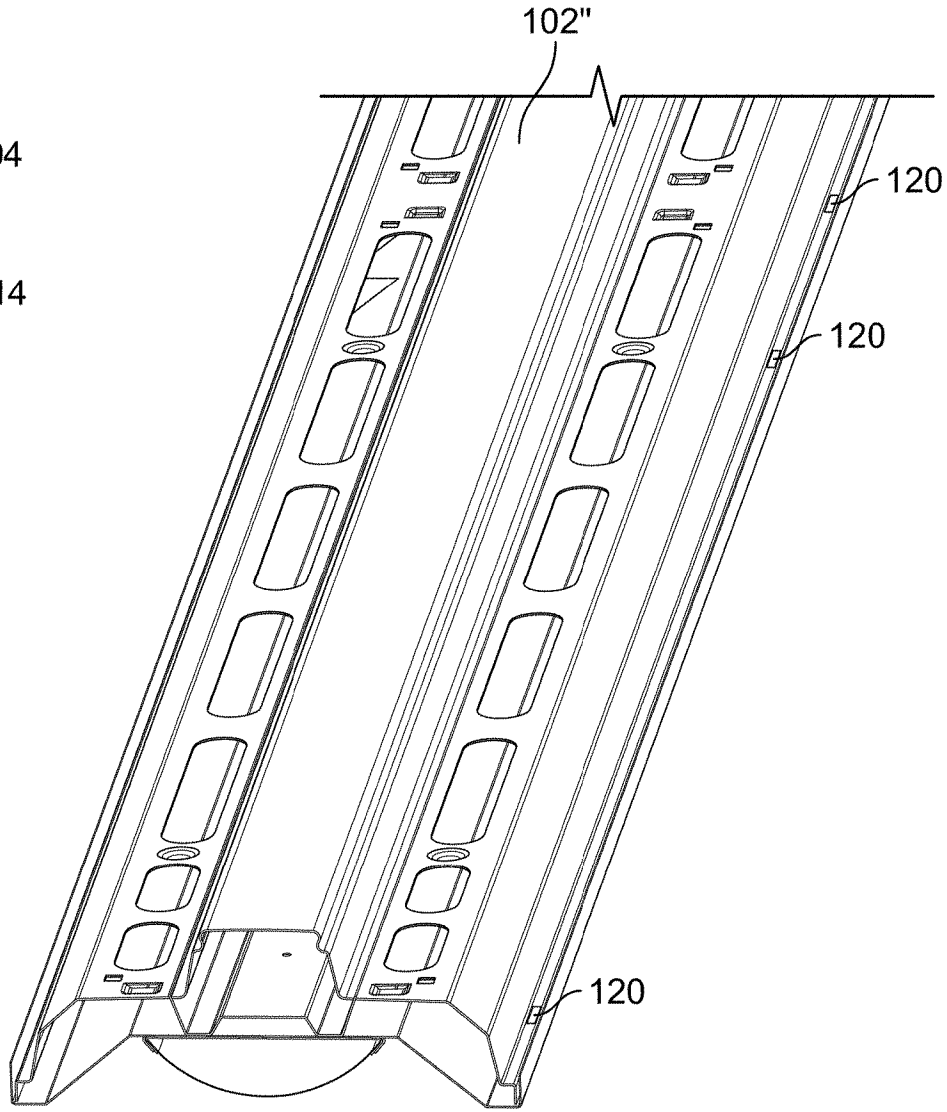
FIG. 12B is a perspective view of a retrofit assembly installed into an existing housing, showing slots in the housing where the adaptor bracket of FIG. 12A can be installed to accommodate additional existing housings.
Figure 12A:
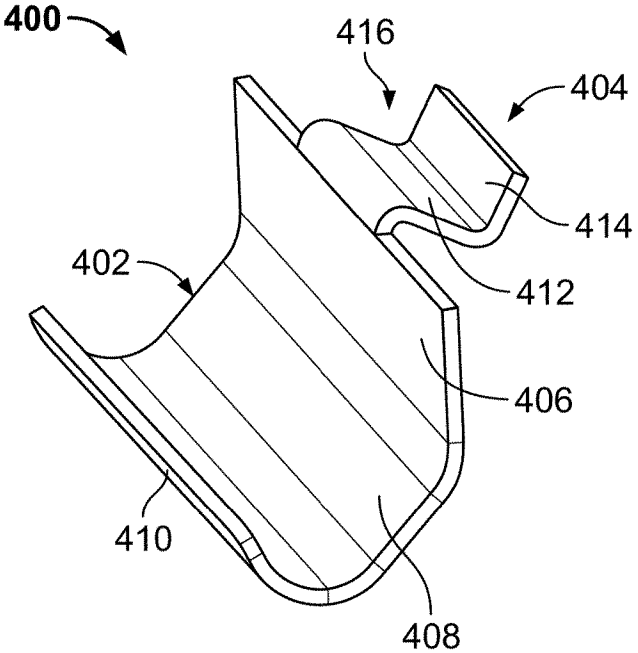
FIG. 12A is a perspective view of an adaptor bracket that can be used to help install a retrofit assembly into an existing housing, according to an exemplary embodiment.
Figure 12D:
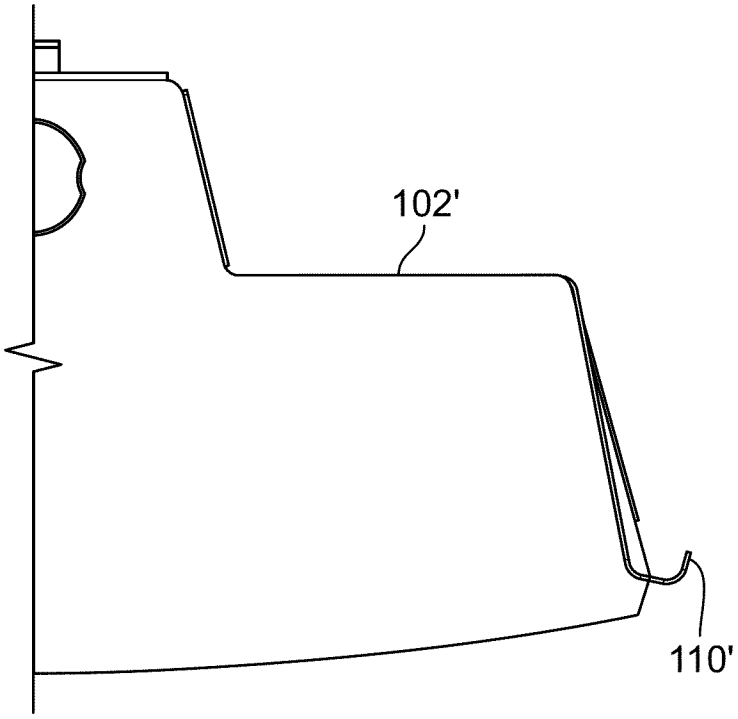
FIG. 12D is a partial front view of the existing housing of FIG. 6A.
Figure 12C:
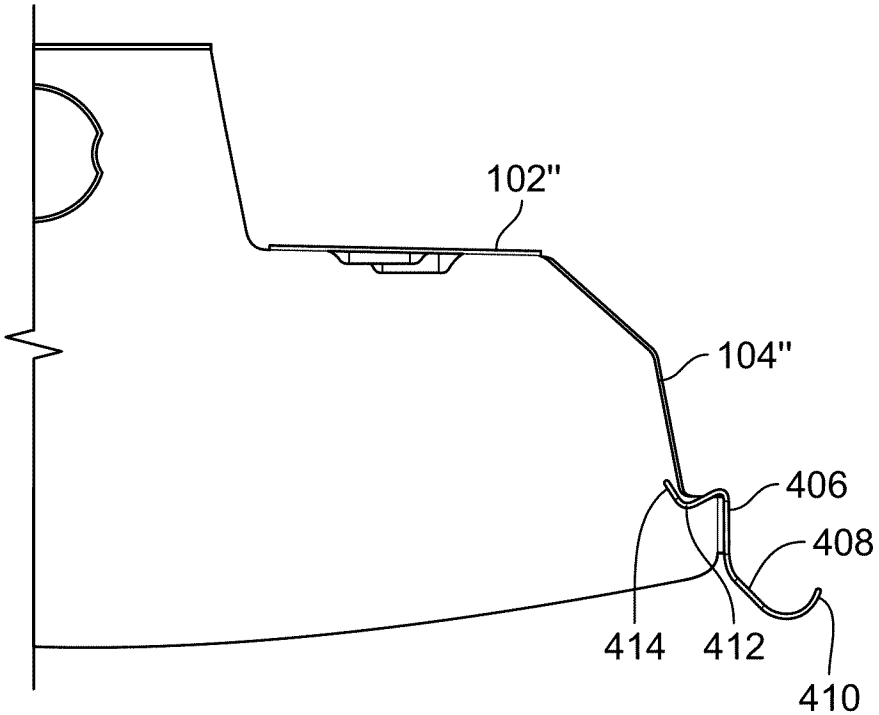
FIG. 12C is a partial front view of the existing housing of FIG. 9A, incorporating the adaptor bracket of FIG. 12A.

The adaptor clips 400 can be coupled to existing housings 102, 102', 102" to alter the shape of the frame 104, 104', 104", and therefore the type of retrofit assembly 200, 200', 200" that can be assembled to the housing 102, 102', 102". For example, and as shown in FIGS. 12B-12C, the tab 404 can be received within a slot 120 formed within the frame 104" of the housing 102". The retaining channel 416 receives an elbow of the frame 104", which is then engaged by the mounting sections 412, 414 to secure the adaptor clip 400 into place. The planar section 406 of the hook 402 can then extend along the outer wall 110" of the housing 102", downwardly away from the housing 102". The concave surface 408 and distal wall 410 then extend the housing 102", creating an outer profile similar to the housing 102', shown in FIG. 12D. The distal wall 410 then serves as an extension of the outer wall 110", and mimics the profile and size of the housing 102'. Accordingly, the same retrofit assembly 200' can be installed into both housings 102', 102", which can reduce costly inventory needs. In some examples, the adaptor clips 400 are designed to extend more than a quarter of the length of the housing 102, 102', 102". The adaptor clip 400 can include several tabs 404 extending away from a singular hook 402 that extends approximately the entire length of the housing 102, 102', 102".

While the retrofit assembly is primarily illustrated coupled to a commercial lighting fixture, it is to be understood that the retrofit assembly may be suitable for residential, outdoor (e.g., area lighting, etc.), and/or industrial lighting (e.g., high bay lighting applications, etc.) as well. It is understood that the particular dimensions supplied herein are only for illustrative purposes; light fixture 100 and the retrofit assembly may have any shape, size, and/or configuration tailored for a target application.

Additionally, the term "LED light source," as used herein, is intended to encompass LED light sources, as well as other classes of solid state lighting, including organic light emitting diode (OLED) light sources, quantum dot light emitting diode (QLED) light sources, and polymer light emitting diode (PLED). The term "LEDs" is similarly intended to encompass LED lights, OLED lights, QLED lights, and PLED lights.

The construction and arrangement of the apparatus, systems, and methods as shown in the various exemplary embodiments are illustrative only. Although only a few embodiments have been described in detail in this disclosure, many modifications are possible (e.g., variations in sizes, dimensions, structures, shapes, and proportions of the various elements, values of parameters, mounting arrangements, use of materials, colors, orientations, etc.). For example, some elements shown as integrally formed may be constructed from multiple parts or elements, the position of elements may be reversed or otherwise varied and the nature or number of discrete elements or positions may be altered or varied. Accordingly, all such modifications are intended to be included within the scope of the present disclosure. The order or sequence of any process or method blocks may be varied or re-sequenced according to alternative embodiments. Other substitutions, modifications, changes, and omissions may be made in the design, operating conditions, and arrangement of the exemplary embodiments without departing from the scope of the present disclosure.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary," as used herein to describe various embodiments, is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

What is claimed is:

1. A retrofit assembly, comprising:

a pan having a base extending along a longitudinal axis and defined by a plurality of segments, the plurality of segments comprising:

a seat extending in a first plane;

a first leg and a second leg, the first leg and the second leg angling laterally and vertically away from opposite sides of the seat;

a first foot extending away from the first leg within a second plane, wherein the second plane is offset from and parallel to the first plane;

a second foot extending away from the second leg within a third plane, wherein the third plane is offset from and parallel to the first plane; and a first retaining wall and a second retaining wall, the first retaining wall and the second retaining wall extending vertically away from the first foot and the second foot toward the first plane;

a light emitting diode light source supporting a plurality of light emitting diodes and coupled to the base; and a driver assembly supported by and coupled to the base opposite the light emitting diode light source, the driver assembly including a driver mount and a driver in electrical communication with the light emitting diode light source and configured to receive a power source, wherein the driver mount is a tray formed of a second plurality of segments, the second plurality of segments comprising:

a driver support surface spaced apart from and extending approximately parallel to the first plane, parallel to the longitudinal axis;

stands extending away from opposing sides of the driver support surface toward the first plane; and mounting surfaces extending away from each of the stands, along the seat, parallel to the first plane.

2. The retrofit assembly of claim 1, wherein fasteners extend through the mounting surfaces and the seat to couple the driver assembly to the pan.

3. The retrofit assembly of claim 1, wherein a width of the driver mount is smaller than a width of the seat, measured perpendicular to the longitudinal axis.

4. The retrofit assembly of claim 1, further comprising a second driver and a second light emitting diode light source, the second driver being supported by and coupled to the driver mount and in electrical communication with the second light emitting diode light source.

5. The retrofit assembly of claim 1, wherein a first lens is coupled to the base and surrounds a portion of the light emitting diode light source, and wherein the first lens is positioned between a sensor bridge and the seat.

6. The retrofit assembly of claim 5, wherein a motion-detecting sensor is mounted to the sensor bridge.

7. The retrofit assembly of claim 5, wherein the sensor bridge is centered within the pan along the longitudinal axis.

8. The retrofit assembly of claim 1, wherein the pan is formed of continuous, bent sheet metal, wherein the first foot and the second foot are coplanar, and wherein each segment is angularly offset from each adjacent planar segment by an angle of at least 80 degrees.

9. A retrofit assembly, comprising:

a pan having a base extending along a longitudinal axis and defined by a plurality of segments, the plurality of segments comprising:

a seat extending in a first plane;

a first leg and a second leg, the first leg and the second leg angling laterally and vertically away from opposite sides of the seat;

a first foot extending away from the first leg within a second plane, wherein the second plane is offset from and parallel to the first plane;

a second foot extending away from the second leg within a third plane, wherein the third plane is offset from and parallel to the first plane; and a first retaining wall and a second retaining wall, the first retaining wall and the second retaining wall extending vertically away from the first foot and the second foot toward the first plane;

a light emitting diode light source supporting a plurality of light emitting diodes and coupled to the base; and a sensor bridge comprising a sensor mounting surface extending between the first leg and the second leg, approximately parallel to the first plane, and further comprising flexible tabs extending into slots formed in the first foot and the second foot.

10. A retrofit assembly, comprising:

a pan having a base extending along a longitudinal axis and defined by a plurality of segments, the plurality of segments comprising:

a seat extending in a first plane;

a first leg and a second leg, the first leg and the second leg angling laterally and vertically away from opposite sides of the seat;

a first foot extending away from the first leg within a second plane, wherein the second plane is offset from and parallel to the first plane;

a second foot extending away from the second leg within a third plane, wherein the third plane is offset from and parallel to the first plane; and a first retaining wall and a second retaining wall, the first retaining wall and the second retaining wall extending vertically away from the first foot and the second foot toward the first plane;

a light emitting diode light source supporting a plurality of light emitting diodes and coupled to the base; and angled brackets having a first portion extending along and mounted to the seat and a second portion angling acutely inward away from the first portion to define a lens cavity, the second portions each resiliently engaging a portion of a lens.

11. A lighting assembly, comprising:

a housing extending along a longitudinal axis and including a first outer wall and a second outer wall, the housing defining a cavity between the first outer wall and the second outer wall, the cavity extending parallel to the longitudinal axis; and a retrofit assembly hingedly coupled to the first outer wall of the housing, the retrofit assembly comprising:

a pan having a base extending along the longitudinal axis and defined by a plurality of segments, the plurality of segments comprising:

a seat extending in a first plane;

a first leg and a second leg, the first leg and the second leg angling away from opposite sides of the seat;

a first foot extending away from the first leg within a second plane, wherein the second plane is offset from the first plane;

a second foot extending away from the second leg within a third plane, wherein the third plane is offset from the first plane; and a first retaining wall and a second retaining wall, the first retaining wall and the second retaining wall extending away from the first foot and the second foot toward the first plane, wherein the first retaining wall and the second retaining wall are positioned outside of the cavity and engage an outer surface of the first outer wall and the second outer wall; and a light emitting diode light source coupled to the base.

12. The lighting assembly of claim 11, wherein the retrofit assembly is hingedly coupled to the first outer wall by a clip simultaneously engaging the first outer wall and one of the first retaining wall and the second retaining wall.

13. The lighting assembly of claim 12, wherein the clip is a U-shaped clip defining a clip cavity therein, and the first outer wall and one of the first retaining wall and the second retaining wall are each partially received within the clip cavity.

14. The lighting assembly of claim 12, wherein the second retaining wall is coupled to the second outer wall of the lighting housing using a second clip simultaneously engaging the second outer wall and the second retaining wall.

15. A lighting assembly, comprising:

a housing extending along a longitudinal axis and including a first outer wall and a second outer wall, the housing defining a cavity between the first outer wall and the second outer wall; and a retrofit assembly at least partially received within the cavity and at least partially surrounding the first outer wall and the second outer wall, the retrofit assembly comprising:

a pan having a base extending along the longitudinal axis and defined by a plurality of segments, the plurality of segments comprising:

a seat extending in a first plane;

a first leg and a second leg, the first leg and second leg angling away from opposite sides of the seat;

a first foot extending away from the first leg within a second plane, wherein the second plane is offset from the first plane;

a second foot extending away from the second leg within a third plane, wherein the third plane is offset from the first plane; and a first retaining wall and a second retaining wall, the first retaining wall and the second retaining wall extending away from the first foot and the second foot toward the first plane, wherein the first retaining wall and the second retaining wall are positioned outside of the cavity and engage an outer surface of the first outer wall and the second outer wall;

a light emitting diode light source coupled to the base; and a lens coupled to the base and surrounding at least a portion of the light source.

16. The lighting assembly of claim 15, wherein the light emitting diode light source is coupled to the seat and includes a plurality of light emitting diodes spaced along the longitudinal axis.

17. The lighting assembly of claim 15, wherein the light emitting diode light source includes a plurality of light emitting diodes facing away from the seat, and configured to direct light orthogonally away from the seat.

18. The lighting assembly of claim 15, wherein the outer walls of the housing are partially defined by adaptor clips received within slots formed through the housing.

* * * * *